US010525738B2

(12) United States Patent
Katagami et al.

(10) Patent No.: US 10,525,738 B2
(45) Date of Patent: Jan. 7, 2020

(54) TRANSPORTING MEDIUM THROUGH DRYING UNIT DURING PRINTING INTERRUPTION

(71) Applicant: SEIKO EPSON CORPORATION, Tokyo (JP)

(72) Inventors: Satoru Katagami, Matsumoto (JP); Yuichi Washio, Matsumoto (JP); Hiroshi Toyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/896,570

(22) Filed: Feb. 14, 2018

(65) Prior Publication Data

US 2018/0229513 A1 Aug. 16, 2018

(30) Foreign Application Priority Data

Feb. 16, 2017 (JP) ..... 2017-026669

(51) Int. Cl.
*B41J 11/00* (2006.01)
*B41J 29/38* (2006.01)
*B41J 13/00* (2006.01)

(52) U.S. Cl.
CPC ..... *B41J 11/002* (2013.01); *B41J 13/0036* (2013.01); *B41J 29/38* (2013.01)

(58) Field of Classification Search
CPC ..... B41J 11/002; B41J 15/046; B41J 29/377; B41J 29/38; B41J 13/0036
See application file for complete search history.

(56) References Cited

U.S. PATENT DOCUMENTS

2003/0161552 A1* 8/2003 Shima ..... B41J 11/002 382/312
2011/0050823 A1* 3/2011 Toya ..... B41J 11/002 347/102
2014/0240388 A1* 8/2014 Walker ..... B41J 11/002 347/16

FOREIGN PATENT DOCUMENTS

JP 2005-001303 A 1/2005

* cited by examiner

*Primary Examiner* — Bradley W Thies
(74) *Attorney, Agent, or Firm* — Workman Nydegger

(57) ABSTRACT

A printing apparatus includes a drying unit that includes a bring-in port where a medium is brought in and a bring-out port where the medium is brought out, and dries ink applied onto the medium, and in a case in which printing is temporarily stopped and a predetermined maintenance work is performed, the medium is transported in a transporting direction which is a direction toward the bring-out port from the bring-in port in a maintenance work period from starting of the maintenance work to finishing of the maintenance work or in a partial period of the maintenance work period.

7 Claims, 14 Drawing Sheets

TRANSPORTING MEDIUM THROUGH DRYING UNIT DURING PRINTING INTERRUPTION

BACKGROUND

1. Technical Field

The present invention relates to a printing apparatus and a printing method of the printing apparatus.

2. Related Art

A printing apparatus which includes a drying device such as a heater in order to promote drying and fixing of ink ejected to a recording medium (medium) is known (for example, JP-A-2005-1303). The printing apparatus disclosed in JP-A-2005-1303 includes a heater as a drying device. In the printing apparatus, in order to prevent the medium from being excessively heated by the heater, while printing is stopped, the recording medium is separated from the heater, and the heater is stopped.

However, in the printing apparatus disclosed in JP-A-2005-1303, there is a problem in that for separating the recording medium from the heater, an apparatus is increased in size and it is difficult to reduce costs or to make the apparatus compact. Further, in order to restart the printing, the heater is reheated from a state of being stopped, and thus it is necessary to hold printing until the heater is reheated up to a temperature for printing, and there is also another problem in that a printing efficiency is deteriorated.

SUMMARY

The invention can be realized in the following aspects or application examples.

Application Example 1

According to this application example, there is provided a printing apparatus including a drying unit that includes a bring-in port where a medium is brought in and a bring-out port where the medium is brought out, and dries ink applied onto the medium, in which in a case where printing is temporarily stopped, and a predetermined interruption work is performed, the medium is transported in a transporting direction which is a direction toward the bring-out port from the bring-in port in an interruption work period from starting the interruption work to finishing the interruption work or in a partial period of the interruption work period.

In a case in which the interruption work is performed in a state in which the printing is temporarily stopped, the medium is transported in a direction toward the bring-out port of the drying unit from the bring-in port of the drying unit in the interruption work period from the starting the interruption work to the finishing the interruption work or in a partial period of the interruption work period, and thus a remaining time of the medium in the drying unit becomes shorter than a case in which the medium is not transported, and thereby a defect (thermal damage of medium) that the medium is excessively heated in the drying unit does not easily occur.

Further, since a large device for separating the medium from the heater is not required, when compared to a case in which the large device for separating the medium from the heater is required, a configuration of the printing apparatus is simplified, and cost reduction and compactness are easily achieved.

Application Example 2

In the printing apparatus according to the application example, it is preferable that the medium be transported at a constant speed or be intermittently transported in the interruption work period or in the partial period of the interruption work period.

When the medium is transported at a constant speed or is intermittently transported in the interruption work period or in the partial period of the interruption work period, the remaining time of the medium in the drying unit becomes shorter than a case in which the medium is not transported, and thereby a defect (thermal damage of medium) that the medium is excessively heated in the drying unit does not easily occur.

Application Example 3

In the printing apparatus according to the application example, it is preferable that the printing apparatus further include a transporting unit that repeatedly performs a transporting process of transporting the medium in the transporting direction by an intermittent transporting distance and a stop process of stopping the medium being transported in the transporting direction, and a printing unit that, during the stoppage of the medium, repeats a main scanning in which the printing unit ejects ink to the medium while moving in a first direction and a sub scanning in which the printing unit moves in a second direction intersecting with the first direction, and performs printing of one frame on the medium, in which a transporting distance of the medium being transported in the transporting direction in the interruption work period or in the partial period of the interruption work period is the intermittent transporting distance.

In the printing apparatus according to the application example, the printing unit is capable of performing the printing of one frame on the medium, and the drying unit is capable of drying the printing of one frame formed on the medium. That is, in the printing apparatus, the printing of one frame can be repeatedly performed on the medium.

If the printing restarts when the transporting distance of the medium being transported during the interruption work is set as the intermittent transporting distance, the medium at the time of restarting printing is positioned at a position at which a printing of next one frame of the printing of one frame performed before the printing is temporarily stopped starts, and the medium does not need to move in order to adjust the position at which the printing starts at the time of restarting the printing, and thereby a printing efficiency capable of quickly restarting printing is improved.

Application Example 4

In the printing apparatus according to the application example, it is preferable that the printing apparatus further include a transporting unit that repeatedly performs a transporting process of transporting the medium in the transporting direction by an intermittent transporting distance and a stop process of stopping the medium being transported in the transporting direction, and a printing unit that, during the stoppage of the medium, repeats a main scanning in which the printing unit ejects ink to the medium while moving in a first direction and a sub scanning in which the printing unit moves in a second direction intersecting with the first direction, and performs printing of one frame on the medium, in which in a case where an interruption work period moving distance, which is a transporting distance of the medium being transported in the transporting direction in the interruption work period or in the partial period of the interruption work period, becomes shorter than the intermittent transporting distance, the medium is further transported in the transporting direction by a difference distance obtained by subtracting the interruption work period moving distance from the intermittent transporting distance after the interruption work period.

In a case in which the transporting distance (interruption work period moving distance) of the medium being transported during the interruption work becomes shorter than a length of the printing of one frame in the transporting direction, after the interruption work, when the medium is further transported in the transporting direction by the difference distance obtained by subtracting the interruption work period moving distance from the length of the printing of one frame in the transporting direction, an interval between the printing of one frame being formed before the interruption work and the printing of one frame being formed after the interruption work can be adjusted to a length of the printing of one frame in the transporting direction. That is, in a case in which a plurality of one frames of printing is formed on the medium, each of the printing of one frame can be disposed at the same pitch.

Application Example 5

In the printing apparatus according to the application example, it is preferable that the printing apparatus further include a transporting unit that repeatedly performs a transporting process of transporting the medium in the transporting direction by an intermittent transporting distance and a stop process of stopping the medium being transported in the transporting direction, and a printing unit that, during the stoppage of the medium, repeats a main scanning in which the printing unit ejects ink to the medium while moving in a first direction and a sub scanning in which the printing unit moves in a second direction intersecting with the first direction, and performs printing of one frame on the medium, and in which in a case where an interruption work period moving distance, which is a transporting distance of the medium being transported in the transporting direction in the interruption work period or in the partial period of the interruption work period, becomes longer than the intermittent transporting distance, the medium is further transported in an opposite direction to the transporting direction by a difference distance obtained by subtracting the intermittent transporting distance from the interruption work period moving distance after the interruption work period.

In a case in which the transporting distance of the medium being transported during the interruption work (interruption work period moving distance) becomes longer than a length of the printing of one frame in the transporting direction, after the interruption work, when the medium is further transported in an opposite direction to the transporting direction by the difference distance obtained by subtracting the interruption work period moving distance from the length of the printing of one frame in the transporting direction, an interval between the printing of one frame being formed before the interruption work and the printing of one frame being formed after the interruption work can be adjusted to a length of the printing of one frame in the transporting direction. That is, in a case in which a plurality of the one frames of printing is formed on the medium, each of the one frames of printing can be disposed at the same pitch.

Application Example 6

In the printing apparatus according to the application example, it is preferable that the printing apparatus include a first mode in which a temperature of the drying unit is decreased by performing a control of electric connection to a heater of the drying unit or a temperature control of the heater after starting the interruption work and the temperature of the drying unit is increased by performing the control of electric connection to the heater of the drying unit or the temperature control of the heater after the interruption work, and a second mode in which the temperature of the drying unit is decreased by performing the control of electric connection to the heater or the temperature control of the heater after starting the interruption work, and the temperature of the drying unit is increased by performing the control of electric connection to the heater or the temperature control of the heater during the interruption work.

In the first mode, since the temperature of the drying unit is decreased by performing the control of electric connection to the heater of the drying unit or the temperature control of the heater after starting the interruption work, and the temperature of the drying unit is increased by performing the control of electric connection to the heater or the temperature control of the heater after the interruption work, the temperature of the drying unit becomes decreased during the interruption work (during temporarily stoppage of printing), and thus a defect (thermal damage of medium) that the medium is excessively heated does not easily occur.

In the second mode, since the temperature of the drying unit is decreased by performing the control of electric connection to the heater of the drying unit or the temperature control of the heater after the starting the interruption work, and the temperature of the drying unit is increased by performing the control of electric connection to the heater or the temperature control of the heater during the interruption work, the temperature of the drying unit becomes decreased during the interruption work (during temporarily stoppage of the printing), and thus the defect (thermal damage of medium) that the medium is excessively heated does not easily occur.

Further, compared to the second mode, in the first mode, it is possible to lower the temperature of the drying unit during the interruption work, and thus the defect (thermal damage of medium) that the medium is excessively heated does not easily occur. Meanwhile, compared to the first mode, in the second mode, it is possible to quickly return the temperature of the drying unit to an original temperature (temperature at the time of printing) at which printing is possible after the interruption work, and thus the printing is enable to quickly restart.

Application Example 7

In the printing apparatus according to the application example, it is preferable that, in the first mode, the control of electric connection to the heater or the temperature control of the heater be performed so that the temperature of the drying unit becomes a standby temperature which is lower than a temperature at the time of starting the interruption work after the starting the interruption work, and the standby temperature be varied depending on the types of the medium.

In a case in which the printing is temporarily stopped and after the interruption work starts, the temperature of the drying unit is decreased so that the temperature of the drying unit becomes the standby temperature lower than a temperature (temperature at the time of printing) at the time of starting the interruption work, and further, after the temperature reaches the standby temperature, when the temperature of the drying unit is maintained at the standby temperature until the interruption work is finished, the temperature of the drying unit is lower than the temperature at the time of printing during the interruption work (during temporarily stoppage of the printing), and thus a defect (thermal damage of medium) that the medium is excessively heated does not easily occur.

When the standby temperature can be varied depending on the types of the medium, for example, since a thermal damage is not easily generated in the medium in which the thermal damage is not easily generated even when the standby temperature is increased, as compared to a medium in which the thermal damage is easily generated, the standby temperature is increased, the temperature of the drying unit is quickly increased higher than the original temperature (temperature at the time of printing) at which printing is possible, and a standby time until the temperature of the drying unit is increased is further reduced, and thereby making it possible to improve a printing efficiency. For example, when the standby temperature is decreased in the medium in which the thermal damage is easily generated, compared to the medium in which the thermal damage is not easily generated, the defect (thermal damage of medium) that the medium is excessively heated does not easily occur during the interruption work (during temporarily stoppage of the printing), even in the medium in which the thermal damage is easily generated.

Application Example 8

According to this application example, there is provided a printing method of a printing apparatus which includes a drying unit that includes a bring-in port where a medium is brought in and a bring-out port where the medium is brought out and dries ink applied onto the medium, the method including, in a case in which printing is temporarily stopped, and a predetermined interruption work is performed, transporting the medium in a direction toward the bring-out port from the bring-in port in the interruption work period from starting the interruption work to finishing the interruption work or in a partial period of the interruption work period and then restarting the printing.

In a case in which the interruption work is performed in a state in which the printing is temporarily stopped, since the medium is transported in the direction toward the bring-out port of the drying unit from the bring-in port of the drying unit in the interruption work period from starting the interruption work to finishing the interruption work or in the partial period of the interruption work period, compared a case in which the medium is not transported, a remaining time of the medium in the drying unit is reduced, and thereby a defect (thermal damage of medium) that the medium is excessively heated in the drying unit does not easily occur.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
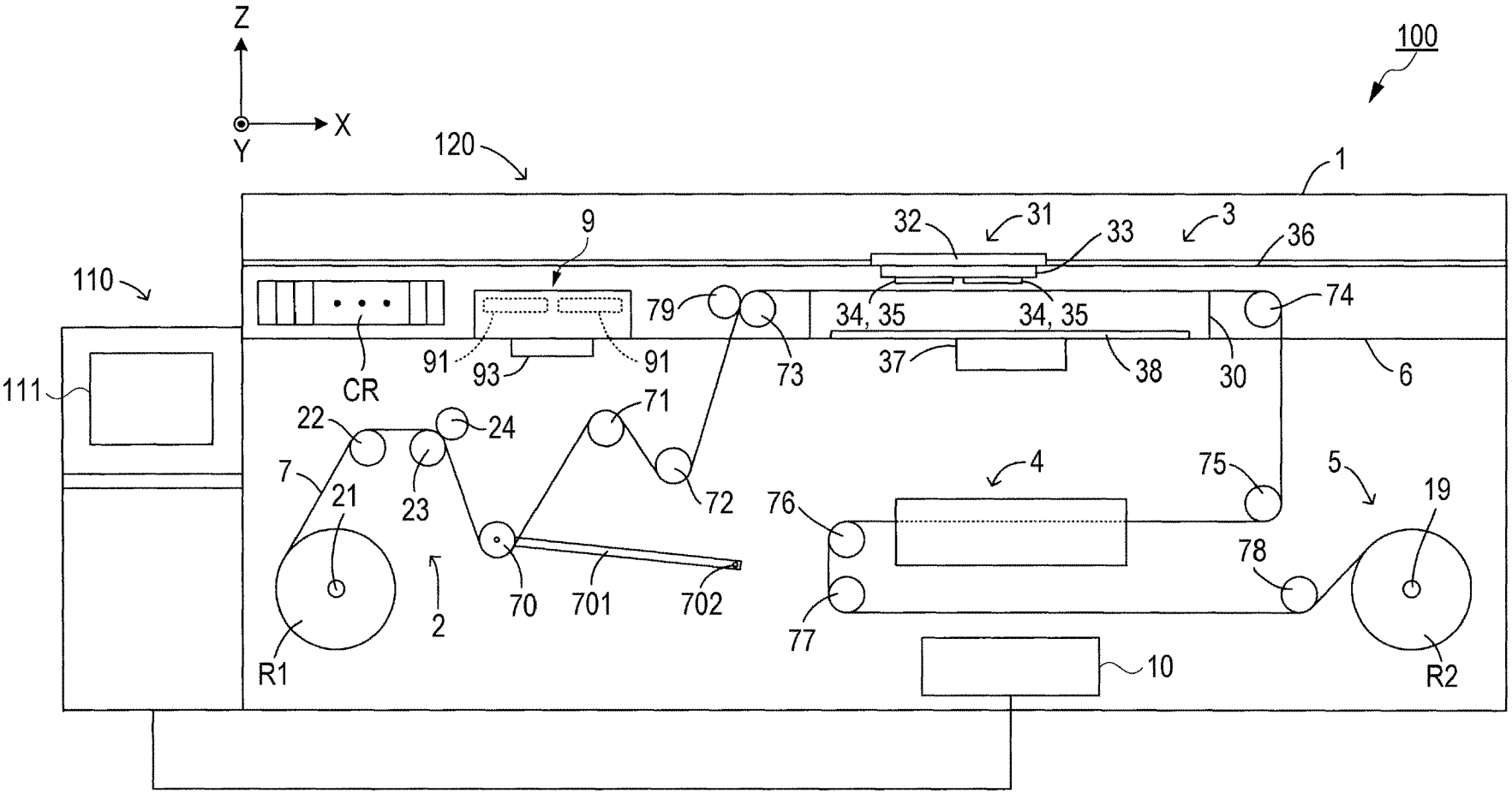
FIG. 1 is a schematic view illustrating an outline of a printing apparatus according to Embodiment 1.

Hereinafter, with reference to drawings, embodiments of the invention will be described. Such embodiments indicate aspects of the invention, and can be arbitrary modified within a scope of a technical idea of the invention without limiting the invention. In addition, in each drawing to be described later, in order to illustrate each layer and each part as a size to be recognizable in the drawings, the sizes of each layer or each part are different from the actual.

Embodiment 1

Outline of Printing Apparatus

Figure 2:
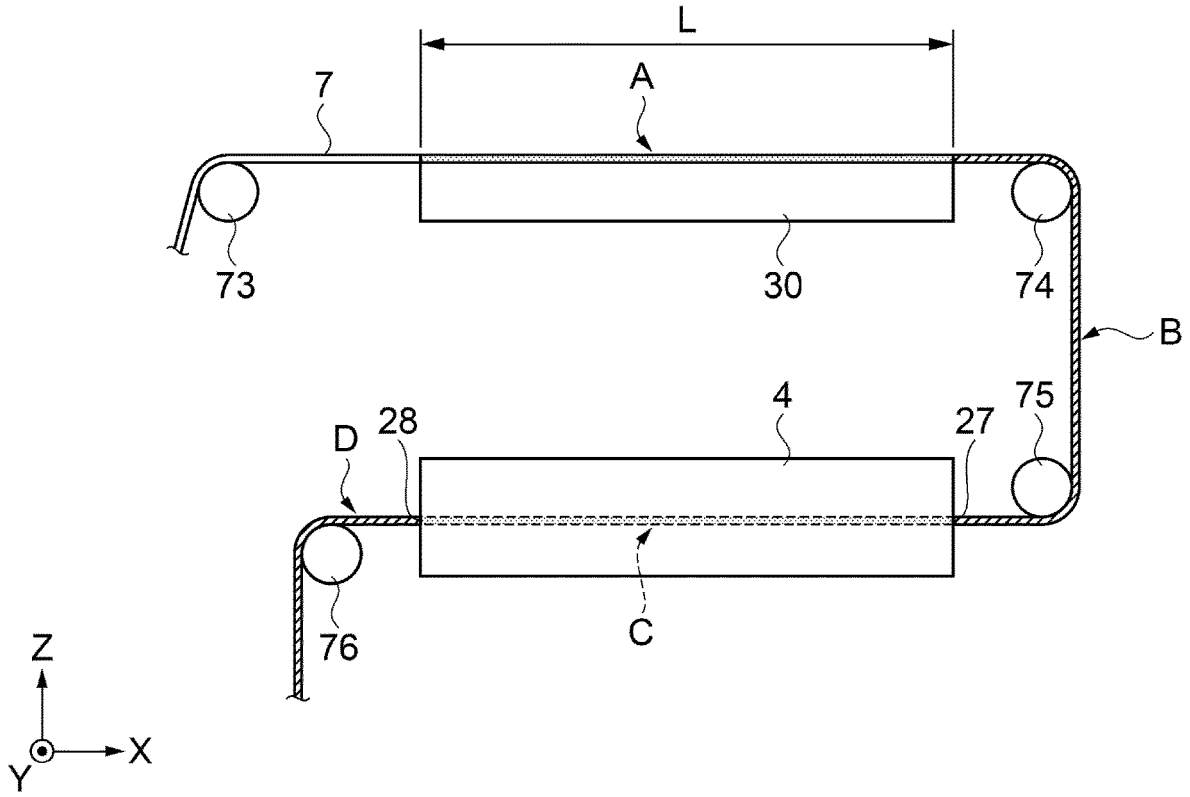
FIG. 2 is a schematic view illustrating a state of an image printed on a medium.
Figure 3:
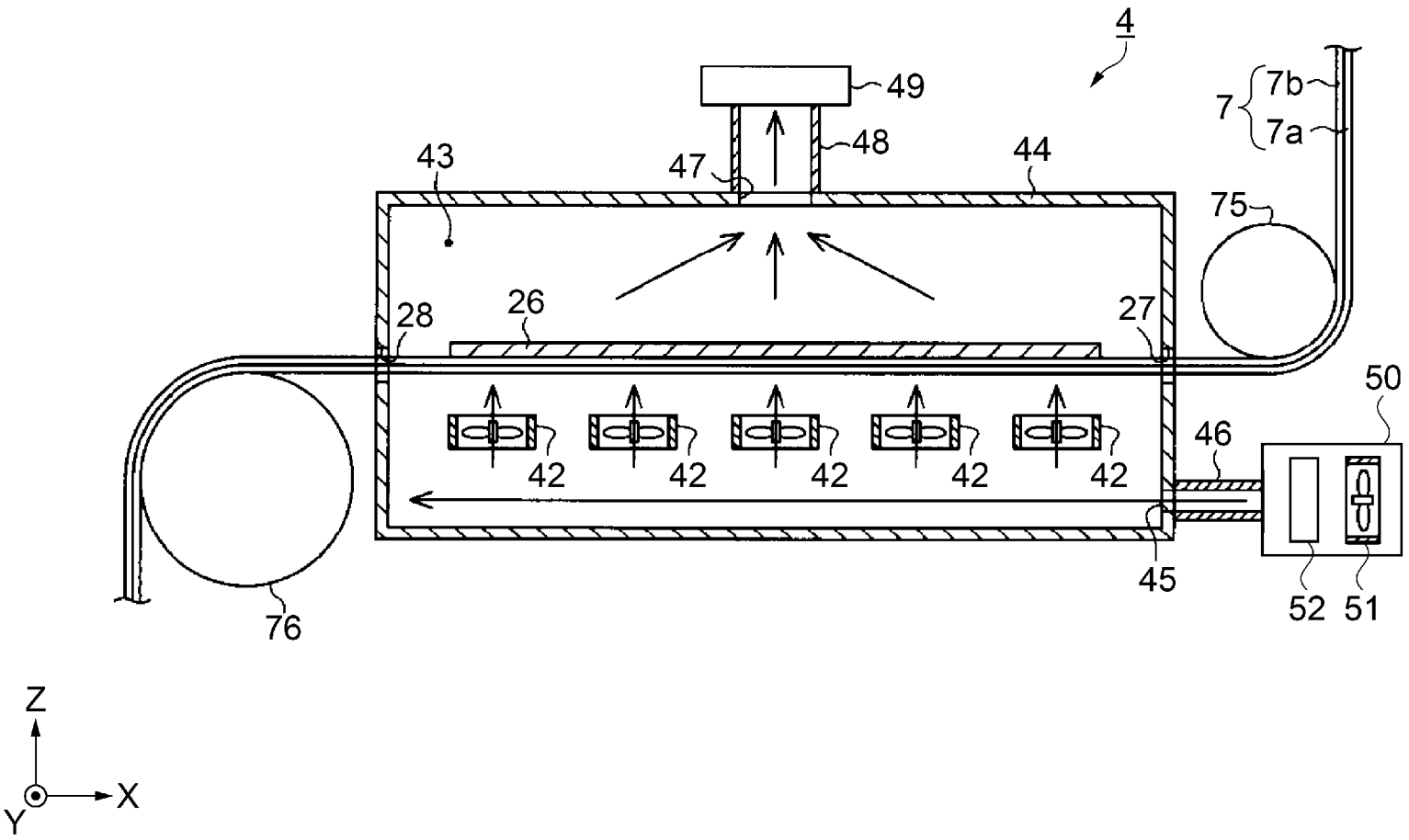
FIG. 3 is a schematic view illustrating an outline of a drying unit.
Figure 4:
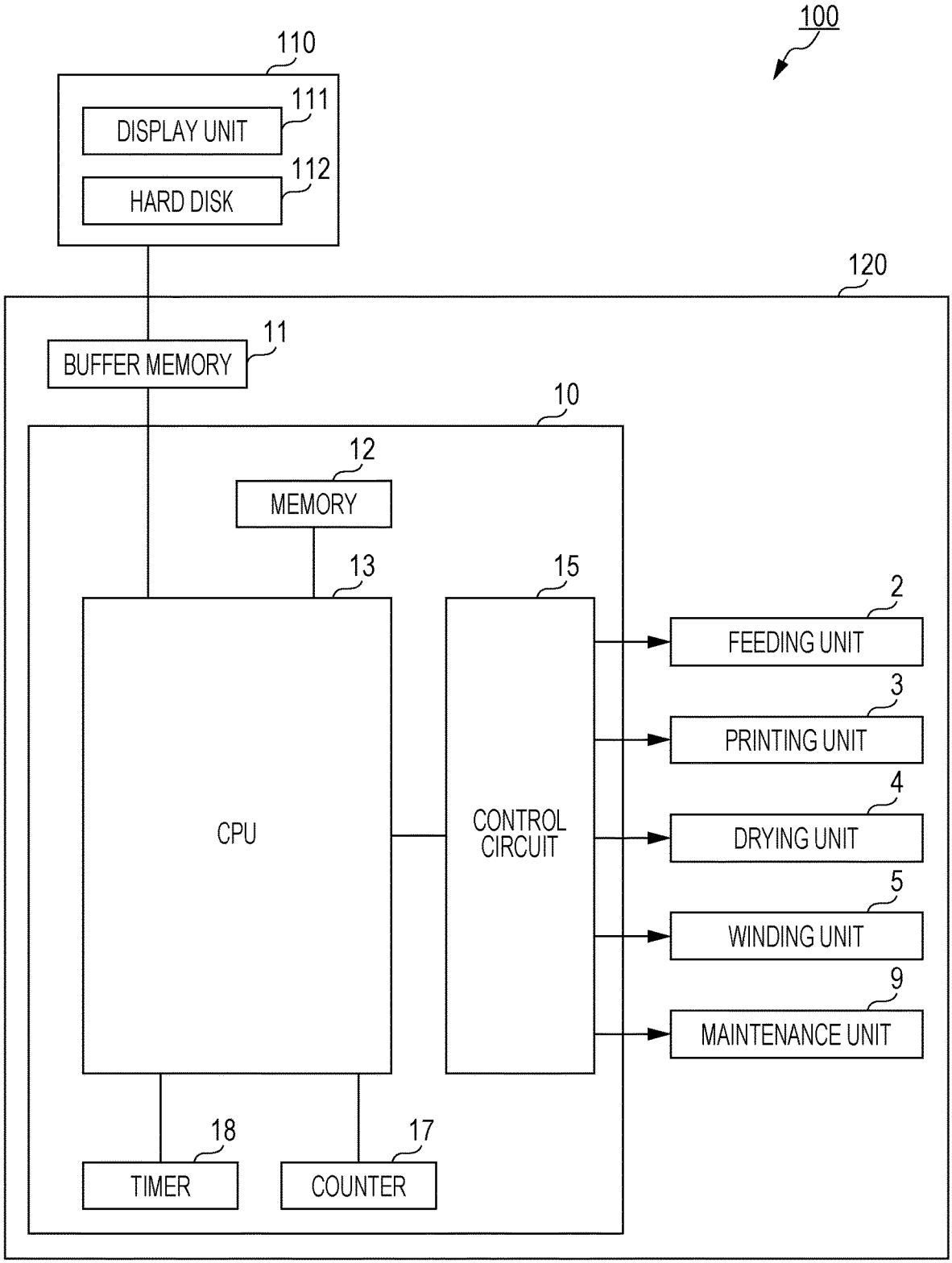
FIG. 4 is a control block diagram of the printing apparatus of Embodiment 1.

FIG. 1 is a schematic view illustrating an outline of a printing apparatus according to Embodiment 1. FIG. 2 is a schematic view illustrating a state of an image printed on a medium. FIG. 3 is a schematic view illustrating an outline of a drying unit. FIG. 4 is a control block diagram of the printing apparatus according to the embodiment.

First, with reference to FIGS. 1 to 4, an outline of a printing apparatus 100 according to the embodiment will be described.

As illustrated in FIG. 1, the printing apparatus 100 according to the embodiment is provided with a host device 110 which generates printing data based on image data received from an external device such as a personal computer, and a printing apparatus main body 120 which performs printing an image based on the printing data received from the host device 110.

The printing apparatus main body 120 feeds a long medium 7 wound in a roll shape and prints an image on the medium 7 in an ink jet method. The printing apparatus main body 120 is provided with a main body case 1 in a substantially rectangular shape.

In the main body case 1, a controller 10 which controls each unit of the printing apparatus main body 120, a feeding unit 2 which feeds the medium 7 unwound from a roll body R1 wound in a roll shape, a printing unit 3 which performs printing on the medium 7 fed from the feeding unit 2 by ejecting ink, a drying unit 4 which dries the medium 7 to which ink is attached, a winding unit 5 which winds the medium 7 after being dried as a roll body R2, and a maintenance unit 9 are disposed.

In description hereinafter, a longitudinal direction of the main body case 1 is set as an X direction, a short-length direction of the main body case 1 is set as a Y direction, and a height direction of the main body case 1 is set as a Z direction. In addition, a direction (distal end side of arrow) where an arrow indicating a direction face is set as a (+) direction, and a direction (base end side of arrow) opposite thereto is set as a (−) direction. In addition, the X direction is an X (+) direction, the Y direction is a Y (+) direction, the Z direction is a Z (+) direction, and each (+) may be omitted and described.

The main body case 1 is divided into an upper part and a lower part in the Z direction by a flat base 6 disposed in parallel to an XY plane (that is, horizontal plane), and an upper side of the base 6 is the printing unit 3. A platen 30 is fixed to an upper surface of the base 6 in a substantial center inside the printing unit 3. The platen 30 has a rectangular shape, and supports the medium 7 from a lower side by an upper surface parallel to the XY plane. Also, a recording unit 31 performs printing on the medium 7 supported on the platen 30.

Meanwhile, the feeding unit 2, the drying unit 4, and the winding unit 5 are disposed on a lower side of the base 6. The feeding unit 2 is disposed on a lower side of the platen 30 in an X (−) direction (obliquely left lower side of FIG. 1), and is provided with a holding shaft 21 which is rotatable and holds the roll body R1 around which the medium 7 is wound. Further, the feeding unit 2 is provided with a roller 22 and a feeding roller 23 which are arranged in the X direction on an upper side of the holding shaft 21. Also, the medium 7 unwound from the roll body R1 of the holding shaft 21 is sequentially stretched to the roller 22 and the feeding roller 23. The feeding roller 23 is a driven roller which has a circumferential surface made of rubber, and is rotated by receiving a driving force from a motor which is not illustrated. Also, the feeding roller 23 has a function of feeding the medium 7 by being rotated in a state of winding the medium 7 which is drawn out from the holding shaft 21. In addition, in order for the feeding roller 23 to be capable of reliably feed the medium 7, a pressing roller 24 which protrudes to the feeding roller 23 is provided in the feeding unit 2, and the pressing roller 24 presses the feeding roller 23 with the medium 7 pinching therebetween.

Meanwhile, the winding unit 5 is disposed on a lower side of the platen 30 in the X (+) direction (obliquely lower side of FIG. 1), and is provided with a winding shaft 19 which is rotatable. The winding shaft 19 supports the roll body R2 around which the medium 7 is wound.

The drying unit 4 is disposed directly under the platen 30 between the feeding unit 2 and the winding unit 5 in the X direction. Moreover, the drying unit 4 is disposed slightly upper than the feeding unit 2 and the winding unit 5. Also, the medium 7 being transported from the feeding unit 2 to the winding unit 5 is guided by a sheet transporting system which is constituted of ten rollers 70 to 79, and sequentially passes through the printing unit 3 and the drying unit 4.

Moreover, a moving direction of the medium 7, which are guided by the sheet transporting system which is constituted of the ten rollers 70 to 79 and moves from the feeding unit 2 to the winding unit 5, is an example of a "transporting direction", and hereinafter, the moving direction is referred to as the transporting direction.

In detail, the medium 7 which is fed by the feeding roller 23 of the feeding unit 2 is sequentially stretched to a driving roller 70 and the rollers 71 and 72. The driving roller 70 is rotatable and pivoted at one end of a rotation frame 701. That is, the driving roller 70 is rotatable based on a rotation shaft 702 which is integral with the rotation frame 701. Also, the driving roller 70 comes into contact with the medium 7, which is stretched between the feeding roller 23 and the roller 71, from the upper side due to its own weight, and applies tension to the medium 7.

Two rollers 73 and 74 are sequentially arranged in the printing unit 3, which is disposed on an upper side of the roller 72, in the X (+) direction. Regarding the rollers 73 and 74, the roller 73 is a driven roller which includes a plurality of minute metallic protrusions on a circumferential surface thereof and is rotated by receiving a driving force from a motor which is not illustrated.

Also, the transporting roller 73 transports the medium 7 onto the platen 30 by being rotated in a state of in which the medium 7, which is transported from the rollers 71 and 72, is wound. Moreover, in order for the transporting roller 73 to reliably perform transportation of the medium 7, the pressing roller 79 which is biased toward the transporting roller 73 is provided in the printing unit 3, and the pressing roller 79 presses the transporting roller 73 with the medium 7 being pinched therebetween.

Also, the transporting roller 73 and the roller 74 are disposed along the X direction so as to pinch the platen 30 therebetween, and positions of the rollers 73 and 74 are adjusted so that an apex of each roller is the same height as that of an upper surface of the platen 30 (a surface supporting the medium 7). The medium 7 wound around the transporting roller 73 slidably comes into contact with the upper surface of the platen 30 in a horizontal direction (X direction) until reaching the roller 74, and the medium 7 wound around the roller 74 is guided downward.

Two rollers 75 and 76 are sequentially disposed on a lower side of the roller 74 (a lower side than the base 6) along the X (−) direction. The medium 7 which is wound around the roller 75 and the roller 76 is guided in parallel (that is, horizontally) along the X direction between both the rollers 75 and 76. In addition, the drying unit 4 is disposed between the rollers 75 and 76. Therefore, a direction of the medium 7 wound around the roller 75 is varied to the X (−) direction, and the medium passes through the inside of the drying unit 4 until reaching the roller 76.

Two rollers 77 and 78 are disposed on a lower side of the roller 76 along the X (+) direction. Also, a direction of the medium 7 wound around the roller 77 is varied toward the X (+) direction, and the medium reaches the roller 78. In addition, the medium 7 which is wound around the roller 78 is wound around the winding unit 5 disposed in the X (+) direction of the roller 78.

As described above, the medium 7 fed from the feeding unit 2 passes through the printing unit 3 or the drying unit 4 and is wound around the winding unit 5. Also, the printing unit 3 performs a printing process on the medium 7 or the drying unit 4 performs a drying process on the medium 7.

The printing unit 3 includes the platen 30, the recording unit 31, and the like. The recording unit 31 includes a carriage 32, a flat shape supporting plate 33 attached to a lower surface of the carriage 32, and a plurality of recording heads 34 attached to a lower surface of the supporting plate 33. The printing process of the printing unit 3 is performed by the recording unit 31 disposed on an upper side of the platen 30. In the recording unit 31, ink, which is supplied by an ink supplying mechanism (not illustrated) from an ink cartridge CR disposed on the X (−) direction side of the platen 30, is ejected from nozzles 35 of the recording head 34, and thus an image is printed on the medium 7.

In detail, the recording head 34 includes a common liquid chamber (not illustrated), a pressure generating chamber (not illustrated), a piezoelectric element (not illustrated), the nozzles 35, and the like. A plurality of nozzles 35 are formed on a surface facing the platen 30 of the recording head 34. The piezoelectric element is a piezoelectric actuator of a bending vibration mode or a piezoelectric actuator of a longitudinal vibration mode. In a state in which the ink is supplied to the pressure generating chamber, the piezoelectric element vibrates a vibration plate constituting a part of the pressure generating chamber, and generates a pressure variation in the pressure generating chamber, such that the ink is ejected from the nozzles 35 to the medium 7 using the pressure variation.

In the recording head 34, the vibration plate constituting a part of the pressure generating chamber is in contact with the piezoelectric element, and is vibrated by driving (vibrating) the piezoelectric element, and if the piezoelectric element stops to be driven, the vibration plate stops to be vibrated. However, when the piezoelectric element stops to be driven, the vibration plate does not immediately stop to be vibrated and residual vibration occurs. Also, when a signal waveform is observed in accordance with the residual vibration being output from the piezoelectric, it is possible to specify a state of the ink inside the recording head 34 (whether or not the ink is in a normal state, whether or not abnormal occurs due to mixing of bubbles into a head, whether or not abnormal occurs due to viscosity of the ink, or whether or not abnormal occurs due to adhesion of foreign materials such as paper to the nozzle 35).

A CPU 13 (refer to FIG. 4) to be described later evaluates whether or not the nozzle 35 of the recording head 34 is normal from the signal waveform in accordance with the residual vibration being output from the piezoelectric element.

In described hereinafter, an inspection for evaluating whether or not the nozzle 35 of the recording head 34 is normal is referred to as an AID inspection using the signal waveform in accordance with the residual vibration being output from the piezoelectric element.

The carriage 32 is movable integrally with the supporting plate 33 and the recording head 34. Specifically, a first guide rail 36 extending in the X direction is provided in the printing unit 3, and the carriage 32 moves in the X direction along the first guide rail 36 by receiving a driving force from a motor which is not illustrated. Further, a second guide rail (not illustrated) extending in the Y direction is provided in the printing unit 3, and the carriage 32 moves in the Y direction along the second guide rail by receiving a driving force from a motor which is not illustrated.

Also, the carriage 32 of the recording unit 31 is two-dimensionally moved in the XY plane with respect to the medium 7 which stops on the upper surface of the platen 30, and thus printing in which an image is printed on the medium 7 is performed.

Specifically, the recording unit 31 alternately repeats an operation (main scanning) in which the ink is ejected to the medium 7 from the nozzle 35 of the recording head 34 by moving the carriage 32 in the X direction (main scanning direction) and an operation (sub scanning) in which the carriage 32 is moved in the Y direction (sub scanning direction) intersecting with the X direction (main scanning direction), and performs the main scanning M times in accordance with a printing resolution, such that one time printing (one frame) is performed. Images A, B, C, and D (refer to FIG. 2) of the one frame are formed on the medium 7 by the printing of one frame.

In other words, the printing unit 3 repeats the main scanning in which the ink is ejected to the medium 7 by moving the carriage in the X direction (main scanning direction) and the sub scanning in which the carriage is moved in the Y direction (sub scanning direction) intersecting which the X direction (main scanning direction), and performs the printing of one frame on the medium 7.

Moreover, the X direction (main scanning direction) is a transporting direction of the medium 7, and is an example of a "first direction". The Y direction (sub scanning direction) intersecting with the X direction (main scanning direction) is an example of a "second direction".

As illustrated in FIG. 2, a predetermined range over the almost entire region on the upper surface of the platen 30 is a printable region. Printing of one frame is performed on the printing region of the medium 7 in accordance with the printing data, and then the images A, B, C, and D (refer to FIG. 2) of the one frame are formed on the medium 7. For example, when the image A of one frame is formed on the medium 7 on the upper surface of the platen 30 at a distance (hereinafter, refer to as intermittent transporting distance L) corresponding to a length L of the X direction (transporting direction) as a unit, the medium 7 is transported in the X direction. In the printing apparatus 100 of the embodiment, an intermittent transportation in which transportation and stoppage of the medium 7 by the intermittent transporting distance L in the transporting direction are repeated is performed, and thus the recording unit 31 performs printing on the medium 7 at the time of the stoppage of the medium 7 (at zero speed). The printing of one frame indicates printing on the medium 7 performed by the recording unit 31 at the time of the stoppage of the medium in the intermittent transportation. Also, an image being printed on the medium 7 by the printing of one frame is referred to as an image of one frame.

For example, when the printing of one frame is performed on a printing surface of the medium 7 stopped on the upper surface of the platen 30, and the image D of one frame is formed on the printing surface of the medium 7, the transporting roller 73 is rotated so as to transport the medium 7 in the transporting direction by the intermittent transporting distance L, and an unprinted surface of the medium 7 is disposed on the upper surface of the platen 30. Subsequently, printing of new one frame is performed on the unprinted surface of the medium 7, and the image C of one frame is formed on the unprinted surface of the medium 7. When the image C of one frame is formed on the unprinted surface of the medium 7, the transporting roller 73 is rotated again so as to transport the medium 7 in the transporting direction by the intermittent transporting distance L, and the unprinted surface of the medium 7 is disposed on the upper surface of the platen 30. Also, a series of these operations is repeatedly performed, and the image D of one frame, the image C of one frame, the image B of one frame, and the image A of one frame sequentially disposed along the transporting direction are formed on the medium 7.

As described above, the printing apparatus main body 120 repeats an operation in which the printing of one frame is performed on the medium 7 and an operation in which the medium 7 after finishing the printing of one frame is transported by the intermittent transporting distance L, such that the images of one frame are repeatedly formed on the medium 7.

In the embodiment, a length of the transporting direction of the platen 30 (a length of a transporting passage of the medium 7), a length of the transporting passage of the medium 7 between the platen 30 and the drying unit 4, and a length of the transporting direction of the drying unit 4 (length of the transporting passage of the medium 7) are respectively set as the intermittent transporting distance L. Therefore, in FIG. 2, the image A of one frame is disposed on the platen 30, the image B of one frame is disposed between the platen 30 and the drying unit 4, and the image C of one frame is disposed on the drying unit 4.

Moreover, the length of the platen 30 in the transporting direction (a length of the transporting passage of the medium 7), the length of the transporting passage of the medium 7 between the platen 30 and the drying unit 4, and the length of the transporting direction of the drying unit 4 (a length of the transporting passage of the medium 7) are not limited to being set as the intermittent transporting distance L, and may be set to be longer than the intermittent transporting distance L, or may be set to be shorter than the intermittent transporting distance L.

Return to FIG. 1, in order to flatly hold the medium 7 stopped on the upper surface of the platen 30, the platen 30 is provided with a mechanism for sucking the medium 7 stopped thereon. Specifically, a plurality of suction holes which is not illustrated is opened to the upper surface of the platen 30, and a sucking unit 37 is attached to a lower surface of the platen 30. Also, the sucking unit 37 is operated, a negative pressure is generated in the suction hole on the upper surface of the platen 30, and the medium 7 is sucked to the upper surface of the platen 30. Also, when the sucking unit 37 flatly holds the medium 7 by sucking the medium 7 during the stoppage of the medium 7 on the platen 30 to be printed, and if the printing is finished, the sucking unit stops to suck the medium 7 so as to be capable of smoothly transporting the medium 7.

Further, a heater 38 is attached to the lower surface of the platen 30. The platen 30 is heated at substantially 35° C. to 45° C. by the heater 38. The printing process is performed on the medium 7 by the recording head 34, and at the same time, the medium is primarily dried due to heat of the platen 30. Because of the primary drying, the ink landed onto the medium 7 is primarily dried, and for example, a defect that the ink landed onto a target position (pixel) of the medium 7 spreads so as to interfere with ink landed onto a target position (adjacent pixel) of the medium 7 is suppressed.

In this manner, on the upper surface of the platen 30, the medium 7 in which the printing of one frame is performed and is primarily dried is moved by the intermittent transportation, and reaches the drying unit 4. That is, the medium 7 in which the printing of one frame is performed is brought in the drying unit 4 by the intermittent transportation. Also, in the printing unit 3, during performing printing of new one frame on the unprinted surface of the medium 7, the medium 7 in which the printing of one frame is performed remains in the drying unit 4. Air heated by a hot air blowing mechanism 50 (refer to FIG. 3) is supplied to the medium 7 which remains in the drying unit 4, and a drying process in which the ink landed onto the printing surface of the medium 7 is completely dried is performed.

In addition, for example, it takes approximately six minutes when printing of new one frame is performed on the unprinted surface of the medium 7 in the printing unit 3, and the medium 7 is intermittently transported for an approximately six-minutes tact time. Therefore, a remaining time (drying time) of the medium 7 in the drying unit 4 is approximately six minutes, and the drying process is performed on the medium 7 on which the printing of one frame is performed for approximately six minutes during the drying unit 4.

Also, the medium 7 on which the drying process is performed in the drying unit 4 is moved by the intermittent transportation, reaches the winding unit 5, and is wound around the winding unit 5 as the roll body R2.

The maintenance unit 9 is disposed on the X (−) direction side with respect to the platen 30. The maintenance unit 9 includes a cap 91, which is provided in an one-to-one corresponding relationship with respect to the recording head 34 of the recording unit 31, and an elevating unit 93 which elevates the cap 91. The maintenance unit 9 performs a maintenance work on the recording head 34 which is evacuated to a home position (directly positioned on maintenance unit) at the time of not printing.

The maintenance work is a work in which printing is temporarily stopped and the recording head 34 is recovered to a normal state. For example, in a case in which generation of defective nozzles in the nozzles 35 of the recording head 34 is recognized by the AID inspection, the printing is temporarily stopped, the predetermined maintenance work is performed, and the defective nozzles are recovered to the normal state. That is, in the printing apparatus main body 120, the maintenance work is performed in a state in which the printing on the medium 7 is temporarily stopped, and the printing on the medium 7 restarts when the maintenance work is finished.

The maintenance work is performed in a case in which a use of the recording head 34 reaches a predetermined condition, a case in which a defect is generated in an image printed on the medium 7, or the like, in addition to a case in which the generation of the defective nozzles in the nozzles 35 of the recording head 34 is recognized by the AID inspection. As an example of the case in which the use of the recording head 34 reaches a predetermined condition, there are a case in which a continuous driving time of the recording head 34 exceeds a predetermined time, a case in which a transporting distance of the medium 7 printed by the recording head 34 reaches a predetermined length, or the like. The maintenance work includes a flushing process and a wiping process which is performed after the flushing process.

In the flushing process, the cap 91 is elevated by the elevating unit 93, a negative pressure is generated inside the cap 91 in a state in which a surface on which the nozzles 35 of the recording head 34 are formed is capped, and ink inside an ink flow passage of the recording head 34 is forcibly discharged from the nozzles 35. By the flushing process, degraded ink (ink with high viscosity, ink including foreign materials, ink including bubbles, and the like) is forcibly discharged from the inside of the ink flow passage of the recording head 34.

In the wiping process, the surface in which the nozzles 35 of the recording head 34 are formed is wiped with a wiper (not illustrated). By the wiping process, ink, dirt, foreign materials, and the like attached to the surface in which the nozzles 35 of the recording head 34 are formed is wiped off with the wiper.

In the embodiment, as the maintenance work, a basic process constituted of the flushing process and the wiping process is performed two times.

Next, a configuration of the drying unit 4 will be described.

As illustrated in FIG. 3, the drying unit 4 includes a case 44 in a box shape in which the inside is empty, supplies the heated air to the medium 7, heats the medium 7, and dries the printing surface of the medium 7.

The medium 7 is constituted of a printing member 7*a* on which printing is performed by ejecting ink in the printing unit 3, and a supporting member 7*b* which can be peeled off from the printing member 7*a*.

The printing member 7*a* is disposed on a side to which the ink is ejected from the nozzles 35 of the recording head 34, and constitutes the printing surface of the medium 7. The printing member 7*a* is made of, for example, a resin film such as a cellophane, oriented polypropylene, polyethylene terephthalate, oriented polystyrene, or polyvinyl chloride. That is, the printing member 7*a* is made of a material (resin) to which moisture in the air is hardly absorbed.

The supporting member 7*b* is disposed on a side of the rollers 22, 23, 71, 73, 74, 75, 76, 77, and 78 which are transports the medium 7, and supports the printing member 7*a*. The supporting member 7*b* is made of high-quality paper, craft paper, copy paper, glassine paper, parchment paper, rayon paper, coated paper, synthetic paper, or the like. That is, the supporting member 7*b* is a fiber aggregate and is made of a material (paper) to which moisture in the air is easily absorbed.

In addition, an adhesive (not illustrated) is disposed between the printing member 7*a* and the supporting member 7*b*, and the printing member 7*a* is attached to the supporting member 7*b* by the adhesive so as to be capable of being peeled off from the supporting member.

An air supplying port 45 is formed to be opened on a lower portion of a side wall portion on the X (+) direction side of the case 44. The hot air blowing mechanism 50 is connected to the air supplying port 45 through an air supplying duct 46.

The hot air blowing mechanism 50 is provided with an axial fan 51 and a heater 52. In the hot air blowing mechanism 50, the air heated by the heater 52 is supplied to the inside of the case 44 by the axial fan 51 through the air supplying port 45 and an air supplying duct 46, and an inner space 43 of the case 44 is heated.

Therefore, a temperature of the drying unit 4 (temperature of inner space 43) is controlled depending on a temperature of hot air which is supplied from the hot air blowing mechanism 50 to the inner space 43. In other words, a control of electric connection to the heater 52 or a temperature control of the heater 52 is performed, and the temperature of the drying unit 4 (temperature of inner space 43) is controlled. That is, in the embodiment, the control of electric connection to the heater 52 or the temperature control of the heater 52 is performed, and the temperature of the drying unit 4 is elevated, or the temperature of the drying unit 4 is decreased.

In addition, an air exhausting port 47 is formed to be opened in the substantially center of an upper wall portion of the case 44, and an air exhausting fan 49 is connected to the air exhausting port 47 through the air exhausting duct 48. Also, the heated air inside the inner space 43 is exhausted to the outside of the case 44 through the air exhausting duct 48 according to driving of the air exhausting fan 49. As a result, a flowage of the heated air is generated in the inner space 43 of the case 44.

Further, a bring-in port 27 where the medium 7 is brought in and a bring-out port 28 where the medium 7 is brought out are formed in a side wall portion of the case 44. The bring-in port 27 is disposed on the X (+) direction side with respect to the air exhausting port 47, and the bring-out port 28 is disposed on the X (−) direction side with respect to the air exhausting port 47. Regarding the bring-in port 27 and the bring-out port 28, a dimension of each of them in the Y direction is greater than a dimension of the medium 7 in the Y direction (dimension in a with direction), such that the medium 7 can pass through these ports.

Inside the case 44, a guide member 26 is disposed between the bring-in port 27 and the bring-out port 28. The guide member 26 supports the supporting member 7*b* of the medium 7, and guides the medium 7 which is brought from the bring-in port 27 to the bring-out port 28. That is, the medium 7 is supported by the supporting member 7*b*, and is transported in a direction toward the bring-out port 28 from the bring-in port 27.

The direction toward the bring-out port 28 from the bring-in port 27 is the transporting direction of the medium 7 which is guided and moved by the sheet transporting system configured of the ten rollers 70 to 79 described above.

Further, inside the case 44, a plurality of the axial fans 42 is disposed along the transporting direction of the medium 7 so as to face the guide member 26. The axial fan 42 is disposed so that an air blowing direction thereof is substantially perpendicular to the printing surface of the medium 7 (printing member 7*a*). Also, the air heated by the hot air blowing mechanism 50 is blown as hot air toward the printing surface (printing member 7*a*) of the medium 7 by the axial fan 42, and thus the medium 7 is heated and the printing surface of the medium 7 is dried.

That is, in the drying unit 4, the air which is heated by the heater 52 of the hot air blowing mechanism 50 is supplied to the medium 7, and the ink landed to the printing member 7*a* of the medium 7 is completely dried and fixed to the printing member 7*a* of the medium 7. As described above, the drying unit 4 includes the bring-in port 27 where the medium 7 is brought in and the bring-out port 28 where the medium 7 is brought out, and dries the ink applied onto the medium 7.

As described above, in the printing apparatus main body 120, the printing unit 3 repeats the operation in which the printing of one frame is performed on the medium 7 and the operation in which the medium 7 is transported by the intermittent transporting distance L after the printing of one frame, and the images of one frame are repeatedly formed on the medium 7. Further, in the drying unit 4, the drying process is performed on the medium 7, and the ink landed on the medium 7 is dried and fixed to the medium 7.

A heating process temperature of the drying unit 4 is set to a temperature (75° C.) at which a thermal damage does not easily occurs in the medium 7 even when the drying unit 4 performs the heating process of the tact time (six minutes) of the printing apparatus main body 120. Further, in a case in which the heating process temperature of the drying unit 4 is 75° C., when the heating process is performed for six minutes by the drying unit 4, the ink landed on the medium 7 can be dried and fixed thereto.

Moreover, details will be described later, but in a case in which the heating process is performed for a long time over six minutes by the drying unit 4, there is a concern that a thermal damage such as wrinkles may be generated in the medium 7.

As illustrated in FIG. 4, the host device 110 includes a display unit 111 and a hard disk 112. The display unit 111 is configured with, for example, a liquid crystal display device including a touch panel, and displays various information items required for a printing control. Further, a worker can register various settings through the touch panel of the display unit 111. The various information items required for the printing control are stored in the hard disk 112.

The printing apparatus main body 120 includes the controller 10 and a buffer memory 11. Printing data written by the host device 110 is supplied to the printing apparatus main body 120 through a system bus, and stored in the buffer memory 11.

The controller 10 is provided with a memory 12, the CPU 13, a counter 17, a timer 18, a control circuit 15, and the like. The memory 12, the CPU 13, the counter 17, the timer 18, and the control circuit 15 are connected to each other by the system bus.

The CPU 13 is a processing device for controlling the entire printing apparatus main body 120, reads required information in printing data from the buffer memory 11, transmits a control signal to the control circuit 15 based on the read information. The control circuit 15 controls each of the feeding unit 2, the printing unit 3, the drying unit 4, the winding unit 5, the maintenance unit 9, and the like. In the memory 12, programs operated by the CPU 13, a calculation result of the CPU 13, and the like are stored. The counter 17 acquires the number of the maintenance works (count value n) being performed. The timer 18 acquires an elapsed time (count value t) taken from starting of the maintenance work (S101 (refer to FIG. 5)).

Problems of Printing Apparatus

Next, problems of the printing apparatus 100 according to the embodiment will be described.

As described above, the medium 7 is constituted of a printing member 7*a* made of a material (resin) to which moisture is hardly absorbed and the supporting member 7*b* made of a material (paper) to which moisture is easily absorbed.

If the heating process is performed for a long time by the drying unit 4, the printing member 7*a* thermally expands, and the dimension of the printing member 7*a* is elongated. Meanwhile, if the heating process is performed for a long time by the drying unit 4, since moisture included in the supporting member 7*b* is evaporated, and intervals between fibers constituting the supporting member 7*b* are shortened, the printing member 7*b* thermally shrinks, and the dimension of the printing member 7*b* is shortened.

Therefore, if the heating process is performed for a long time by the drying unit 4, since the printing member 7*a* thermally expands, and the supporting member 7*b* thermally shrinks, the printing member 7*a* is peeled off from the supporting member 7*b*, the printing member 7*a* floats from the supporting member 7*b*, and the thermal damage such as wrinkles is generated in the medium 7.

In the printing apparatus 100, for example, in a case in which generation of defective nozzles in the nozzles 35 of the recording head 34 is recognized by the AID inspection, the printing is temporarily stopped, and the maintenance work is performed. For example, during the maintenance work, when the medium 7 is stopped to be transported, and the medium 7 remains in the drying unit 4, the drying unit 4 performs the heating process of a long time over approximately six minutes (excessive heating process), and thus the thermal damage such as wrinkles is generated in the medium 7, and there is a concern that the medium 7 may become defective. That is, in a case in which printing is temporarily stopped and the maintenance work is performed, the excessive heating process is performed on the medium 7 which remains in the drying unit 4, the thermal damage such as wrinkles is generated in the medium 7, and thus there is a concern that the medium 7 may become defective and need to be discarded.

Further, if a new medium 7 is wound around the medium 7 in which the thermal damage such as wrinkles is generated, the thermal damage also badly influences on the new medium 7, and there is a concern that the new medium 7 may also become defective. Further, if the thermal damage such as wrinkles becomes remarkable, there is a concern that a winding shape of the roll body R2 of the medium 7 which is wound by the winding unit 5 may be disordered.

The printing apparatus 100 according to the embodiment includes a configuration in which the thermal damage such as wrinkles is hardly generated in the medium 7 which remains in the drying unit 4 even in a case in which the printing is temporarily stopped by the maintenance work.

Hereinafter, details thereof will be described.

Control Method of Printing Apparatus

Figure 5:
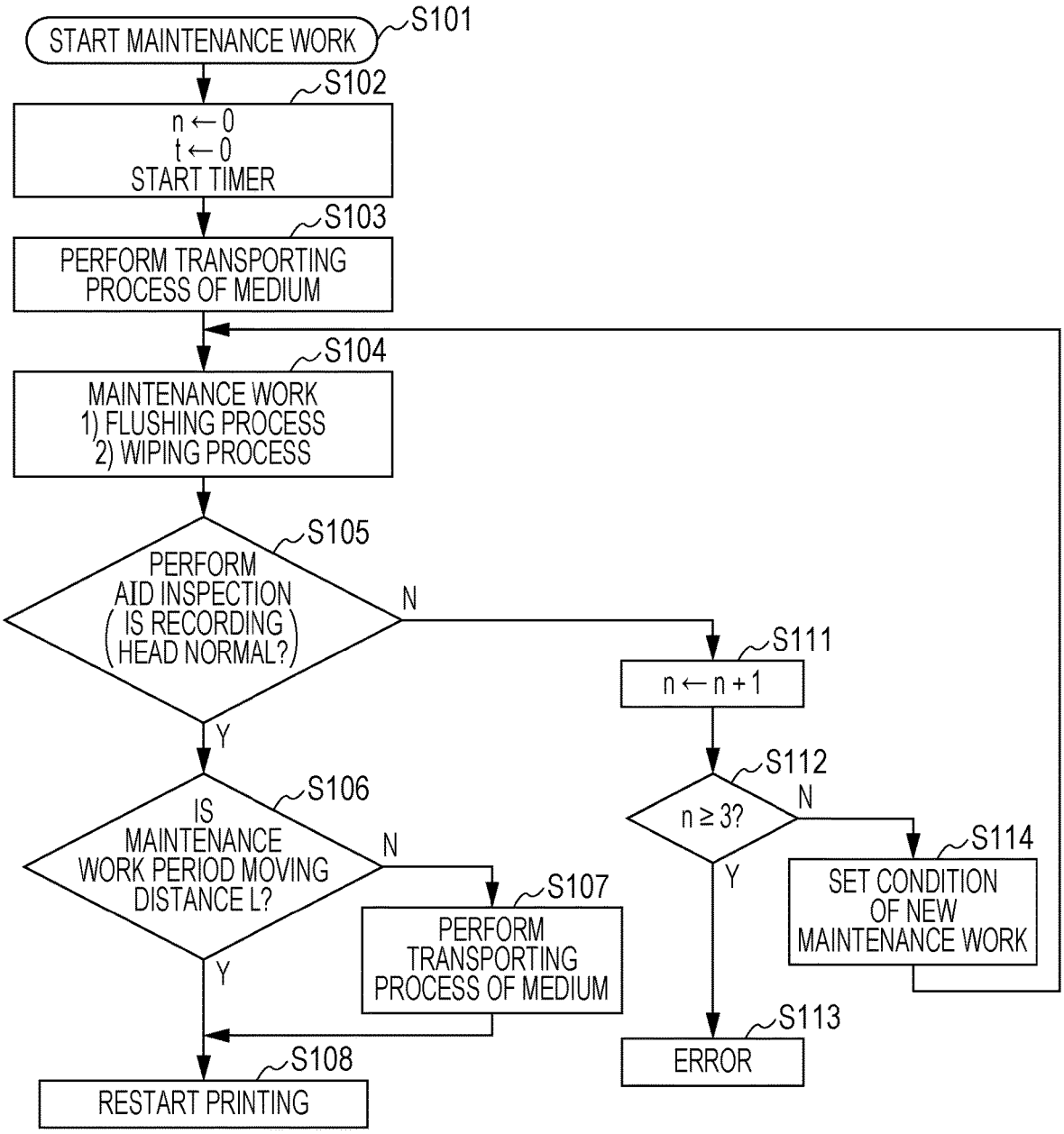
FIG. 5 is a flow chart illustrating a first control method of the printing apparatus according to an embodiment.

FIG. 5 is a flow chart illustrating a control method of the printing apparatus according to the embodiment. FIGS. 6A to 6G are views corresponding to FIG. 2, and are schematic views illustrating a transporting state of the medium in the transporting process of the medium. FIG. 7 is a graph illustrating how long a medium remains in the drying unit in a case in which the transporting process of the medium is performed.

In FIG. 7, the remaining time of the medium 7 in the drying unit 4 is illustrated in a vertical axis, and the count value t of the timer 18 is illustrated in a horizontal axis.

Further, in order to easily understand the state of the medium 7 in the maintenance work, in FIGS. 6A to 6G, the medium 7 on regions B1, B2, B3, B4, B5, and B6 in which the image B of one frame is formed is illustrated by a solid line, and the medium 7 on the other regions illustrated by a broken line. Further, hatching is applied to the medium 7 on the regions B1, B2, B3, B4, B5, and B6.

Hereinafter, with reference to FIGS. 5 to 7, an outline of the control method of the printing apparatus 100 according to the embodiment will be described. Moreover, in the embodiment, in a case in which a defect is generated in the recording head 34, the maintenance work in which the recording head 34 is recovered to a normal state is performed three times, and the recording head 34 is recovered to the normal state at a third maintenance work.

As illustrated in FIG. 5, in a case in which generation of defective nozzles in the nozzles 35 of the recording head 34 is recognized by the AID inspection, the case in which the use of the recording head 34 reaches a predetermined condition, a case a defect is generated in an image printed in the medium 7, or the like, the printing on the medium 7 is temporarily stopped, and the maintenance work starts (S101).

In addition, there is a case in which the maintenance work automatically starts, or a case in which the maintenance work is manually started by being selected from a worker. For example, the CPU 13 determines that the recording head 34 needs to be maintained in the case in which the use of the recording head 34 reaches a predetermined condition, causes the printing to be automatically stopped, and causes the maintenance work to automatically start. For example, in a case in which the defect is generated in the image, the worker starts the maintenance work manually.

Moreover, regarding a timing when the printing on the medium 7 is temporarily stopped, printing on the medium is temporarily stopped at a timing after finishing of the printing of one frame, in other words, at a timing when the printing by the recording unit 31 is not performed and the medium 7 is stopped.

Subsequently, in S102, the CPU 13 sets the count value n of the counter 17 to zero (initial value). Further, the CPU 13 sets the count value t of the timer 18 to zero (initial value), and causes the timer 18 to start counting.

Subsequently, in S103, the CPU 13 controls the sheet transporting system constituted by the ten rollers 70 to 79, and causes the medium 7 to be transported in the transporting direction. Also, the medium 7 is transported in a direction toward the bring-out port 28 from the bring-in port 27 in the drying unit 4.

Moreover, a "case in which an interruption work is performed" in this disclosure corresponds to a case in which S101 (maintenance work starts) is performed. In the embodiment, in a case in which the printing on the medium 7 is temporarily stopped, and S101 is performed (in a case in which the interruption work is performed), S103 (transporting process of medium 7) is performed.

Further, S103 (the transporting process of the medium 7) may be performed with S102 (initial setting of count values n and t, and starting of timer) at the same time, or may be performed before S102 (initial setting of count values n and t, and starting of timer).

Subsequently, in S104, the CPU 13 controls the maintenance unit 9, and performs a first maintenance work. Moreover, the first maintenance work is a maintenance work being performed in S104 in a case in which the count value n is set to zero (initial value). In the maintenance work in S104, the basic process constituted of the flushing process and the wiping process are performed two times. The transporting process of the medium 7 in S103 is continuously performed during the maintenance work of S104.

Moreover, the maintenance work is an example of the "interruption work".

Subsequently, in S105, the CPU 13 performs a first AID inspection, and determines whether or not the recording head 34 is recovered to the normal state by the first maintenance work in S104. In addition, a predetermined time taken from the maintenance work of S104 to the AID inspection of S105 is approximately three minutes.

In a case in which the recording head 34 in S105 is determined to be not recovered to the normal state (determination is N in S105), through S111, S112, and S114, a new maintenance work (second maintenance work) is performed in S104.

In a case in which the recording head 34 in S105 is determined to be recovered to the normal state (in a case in which determination is Y in S105), S103 (the transporting process of the medium 7) stops, and S106 is performed.

"In a case in which the interruption work is finished" in this disclosure corresponds to a case in which the recording head is determined as Y in S105 (AID inspection). "In a case in which the interruption work starts" in this disclosure corresponds to a case in which S101 (starting of maintenance work) is performed. "An interruption work period from starting the interruption work to finishing the interruption work" in this disclosure corresponds to a period from starting of S101 to determination of Y in S105.

Also, in the embodiment, in the interruption work period from the starting of S101 (maintenance work starts) to the determination of Y in S105 (AID inspection), or in a partial period of the interruption work period from the starting of S101 (maintenance work starts) to the determination of Y in S105 (AID inspection), the transporting process in which the medium 7 (S103) is transported in the transporting direction, which is a direction where the medium 7 is transported toward the bring-out port 28 from the bring-in port 27, is performed.

Moreover, since S101 (starting of maintenance work), S102 (initial setting of count values n and t, and starting of timer), S103 (transporting process of medium 7), and S104 (maintenance work) are performed substantially at the same time, "in a case in which the interruption work starts" in this disclosure can be regarded as a case in which S104 (maintenance work) starts. Therefore, the "interruption work period from the starting the interruption work to the finishing the interruption work" in this disclosure can be regarded as a period from starting of S104 (maintenance work) to determination of Y in S105 (AID inspection).

That is, the embodiment includes a configuration in which the transporting process of the medium 7 (S103) is performed in a period from the starting of S104 (maintenance work) to the determination of Y in S105 (AID inspection), or in a partial period of the period from the starting of S104 (maintenance work) to the determination of Y in S105 (AID inspection).

In description hereinafter, the period from the starting of S104 (maintenance work) to the determination of Y in S105 (AID inspection), and a distance by which the medium 7 is transported in the transporting process of the medium 7 (S103) are referred to as a maintenance work period moving distance.

Moreover, the maintenance work period moving distance is an example of an "interruption work period moving distance".

In the transporting process of the medium 7 (S103), the medium 7 is intermittently transported in the transporting direction under a condition in which the intermittent transporting distance L is divided into six parts. In detail, in the transporting process of the medium 7 (S103), the medium 7 is intermittently transported in the transporting direction, such that a transporting distance of the medium 7 becomes (1/6)×the intermittent transporting distance L in a case in which the count value t is one minute, the transporting distance of the medium 7 becomes (2/6)×the intermittent transporting distance L in a case in which the count value t is two minutes, the transporting distance of the medium 7 becomes (3/6)×the intermittent transporting distance L in a case in which the count value t is three minutes, the transporting distance of the medium 7 becomes (4/6)×the intermittent transporting distance L in a case in which the count value t is four minutes, the transporting distance of the medium 7 becomes (5/6)×the intermittent transporting distance L in a case in which the count value t is five minutes, and the transporting distance of the medium 7 becomes (6/6)×the intermittent transporting distance L in a case in which the count value t is six minutes.

Moreover, a transporting speed of the medium 7 is arbitrary. For example, in a case in which the count value t is zero to one minute, the medium 7 is stopped to be transported if the transporting distance of the medium 7 becomes (1/6)×the intermittent transporting distance L, and transportation of the medium 7 restarts if the count value t is set to one minute. Further, in a case in which the count value t is one minute to two minutes, the medium 7 is stopped to be transported if the transporting distance of the medium 7 becomes (2/6)×the intermittent transporting distance L, and the transportation of the medium 7 restarts if the count value t is set to two minutes. Further, in a case in which the count value t is two minutes to three minutes, the medium 7 is stopped to be transported if the transporting distance of the medium 7 becomes (3/6)×the intermittent transporting distance L, and the transportation of the medium 7 restarts if the count value t is set to three minutes. Further, in a case in which the count value t is three minutes to four minutes, the medium 7 is stopped to be transported the transporting distance of the medium 7 becomes (4/6)×the intermittent transporting distance L, and the transportation of the medium 7 restarts if the count value t becomes four minutes. Further, in a case in which the count value t is four minutes to five minutes, the medium 7 is stopped to be transported if the transporting distance of the medium 7 becomes (5/6)×the intermittent transporting distance L, and the transportation of the medium 7 restarts if the count value t is five minutes. Further, in a case in which the count value t is five minutes to six minutes, the medium 7 is stopped to be transported if the transporting distance of the medium 7 becomes (6/6)×the intermittent transporting distance L.

As described above, transporting and stop of the medium 7 are repeated at one minute cycle. Further, even in a case in which the count value t exceeds six minutes, in the same manner, the medium 7 is intermittently transported in the transporting direction under a condition in which the intermittent transporting distance L is divided into the six parts.

In a case in which determination is Y in S105, and S106 is performed, the CPU 13 controls the sheet transporting system, and stops the transporting process of the medium 7. Subsequently, the CPU 13 acquires the maintenance work period moving distance of the medium 7 through an encoder (not illustrated) of the sheet transporting system, and evaluates whether or not the maintenance work period moving distance is the intermittent transporting distance L.

In a case in which the maintenance work period moving distance is evaluated as the intermittent transporting distance L in S106 (in a case in which determination is Y in S106), S108 is performed. Also, in S108, the CPU 13 controls the feeding unit 2, the printing unit 3, the drying unit 4, and the winding unit 5, and printing on the medium 7 restarts.

As described above, in the embodiment, the maintenance work period moving distance is set as the intermittent transporting distance L, the printing on the medium 7 restarts. When the maintenance work period moving distance is set as the intermittent transporting distance L, and the printing on the medium 7 restarts, an interval between a top position of the image of one frame formed on the medium 7 before the maintenance work and a top position of the image of one frame formed on the medium 7 after the maintenance work becomes the intermittent transporting distance L, and the printing is possible to immediately restart without moving the medium 7 to be adjusted to a print starting position after finishing of the maintenance work.

In a case in which the maintenance work period moving distance is evaluated not to the intermittent transporting distance L (in a case in which determination is N in S106) in S106, S107 is performed.

For example, in a case in which determination is N in S106, and the maintenance work period moving distance becomes shorter than the intermittent transporting distance L, in S107, the CPU 13 controls the sheet transporting system, and causes the medium 7 to be further transported in the transporting direction (a direction toward the bring-out port 28 from the bring-in port 27) by a difference distance obtained by subtracting the maintenance work period moving distance from the intermittent transporting distance L.

For example, in a case in which determination is N in S106, and the maintenance work period moving distance becomes longer than the intermittent transporting distance L, in S107, the CPU 13 controls the sheet transporting system, and causes the medium 7 to be further transported in an opposite direction to the transporting direction (a direction toward the bring-in port 27 from the bring-out port 28) by a difference distance obtained by subtracting the intermittent transporting distance L from the maintenance work period moving distance.

If the recording head 34 is recovered to the normal state by only the first maintenance work, since a required time taken from the first maintenance work of S104 to the first AID inspection of S105 is three minutes, and the maintenance work period moving distance of the medium 7 is (3/6)×the intermittent transporting distance L, the medium 7 is transported in the transporting direction (a direction toward the bring-out port 28 from the bring-in port 27), such that the maintenance work period moving distance is determined to be shorter than the intermittent transporting distance L in S106, and the maintenance work period moving distance of the medium 7 becomes the intermittent transporting distance L in S107.

Also, in S107, when the medium 7 is transported in the transporting direction so that the maintenance work period moving distance becomes the intermittent transporting distance L, the printing on the medium 7 restarts in S108.

In the embodiment, since the recording head 34 is recovered to the normal state in the third maintenance work (S104), determination is N in S105 (first AID inspection), and S111 is performed. In S111, the CPU 13 causes the counter 17 to count up the count value n. In detail, since the count value n is set to zero (initial value) in S102, the count value n is counted up from zero to one in S111.

Subsequently, in S112, the CPU 13 determines whether or not the count value n is three or more (determination is Y or not), and whether or not the count value n is smaller than three (determination is N or not). Since the count value n which is counted up in S111 is one, the count value n is determined to be smaller than three in S112 (determination is N), and S114 is performed.

In S114, the CPU 13 sets a condition of a new maintenance work (second maintenance work). That is, the CPU 13 sets conditions of the flushing process and the wiping process in the new maintenance work (second maintenance work).

The condition of the flushing process is a pressure (degree of negative pressure) in the inside of the cap 91 in which the recording head 34 is capped, or a time (suction time when the negative pressure acts) when the ink is forcibly discharged from the nozzle 35 by the negative pressure. For example, when the negative pressure is lowered and the suction time becomes longer, the deteriorated ink is likely to be discharged from the recording head 34.

The condition of the wiping process is a pressing force of a wiper with respect to the recording head 34 or a moving speed of the wiper. For example, when the pressing force of the wiper becomes strong and the moving speed of the wiper becomes slow, dirt or foreign materials are likely to be removed from the recording head 34.

In a case in which the ink flow passage of the recording head 34 is blocked due to the deteriorated ink, a case in which the nozzle 35 is blocked due to dirt or foreign materials, or the like, since the recording head 34 is determined to be not recovered to the normal state, when the condition such as the negative pressure or the suction time in the flushing process, or the pressing force or the moving speed in the wiping process is changed, the recording head 34 is likely to be recovered to the normal state.

However, when the condition of the flushing process is changed in a direction where the recording head 34 is easily recovered to the normal state, there is a concern that an adverse influence of which the ink is easily wasted occurs. When the condition of the wiping process is changed in the direction where the recording head 34 is easily recovered to the normal state, there is a concern that an adverse influence of which the recording head 34 is easily damaged occurs.

In consideration of such adverse influences, a worker registers (stores) the conditions of the flushing process and the wiping process in a new maintenance work to the memory 12 through the display unit 111. The CPU 13 sets a condition of the new maintenance work with reference to the conditions stored in the memory 12. That is, the CPU 13 determines whether or not the maintenance work same as the first maintenance work, or the maintenance work different from the first maintenance work is performed with reference to the registered conditions.

Subsequently, in S104, the CPU 13 controls the maintenance unit 9, and performs the second maintenance work under the conditions of the new maintenance work set in S114.

Subsequently, in S105, the CPU 13 performs a second AID inspection, and determines whether or not the recording head 34 is recovered to the normal state by the second maintenance work of S104. Also, in a case in which the recording head 34 is determined to be recovered to the normal state in S105 (in a case in which determination is Y in S105), S106 is performed.

In a case in which the recording head 34 is determined to be not recovered to the normal state in S105 (in a case in which determination is N in S105), S111 is performed.

When the recording head 34 is recovered to the normal state by the second maintenance work of S104, determination is Y in the second AID inspection of S105, and in S106, the CPU 13 controls the sheet transporting system, stops the transporting process of the medium 7, and evaluates whether or not the maintenance work period moving distance is the intermittent transporting distance L.

Since the required time taken from the first maintenance work of S104 to the second AID inspection of S105 is six minutes, and the maintenance work period moving distance of the medium 7 is (6/6)×the intermittent transporting distance L, the maintenance work period moving distance is determined to be the intermittent transporting distance L (determination is Y in S106) in S106, and the printing on the medium 7 restarts in S108.

In the embodiment, since the recording head 34 is recovered to the normal state by the third maintenance work, the determination is N in the second AID inspection of S105, and S111 is performed. Also, in S111, the CPU 13 causes the counter 17 to count up the count value n from one to two.

Since the count value n counted up in S111 is two, the count value n is determined to be smaller than three in S112 (N), and the condition of the new maintenance work is set in S114. Also, in S104, the CPU 13 controls the maintenance unit 9, and performs the third maintenance work under a condition of the new maintenance work set in S114.

Subsequently, in S105, the CPU 13 performs a third AID inspection, and determines whether or not the recording head 34 is recovered to the normal state by the third maintenance work. In the embodiment, since the recording head 34 is recovered to the normal state by the third maintenance work of S104, the recording head 34 is determined to be recovered to the normal state in the third AID inspection of S105 (determination is Y in S105), and in S106, the CPU 13 controls the sheet transporting system, stops the transporting process of the medium 7, and evaluates whether or not the maintenance work period moving distance is the intermittent transporting distance L.

Since the required time taken from the first maintenance work of S104 to the third AID inspection of S105 is nine minutes, and the maintenance work period moving distance of the medium 7 is (9/6)×the intermittent transporting distance L, in S106, the maintenance work period moving distance is determined to be longer than the intermittent transporting distance L, and in S107, the CPU 13 controls the sheet transporting system, and causes the medium 7 to be further transported in an opposite direction (a direction toward the bring-in port 27 from the bring-out port 28) to the transporting direction by the difference distance obtained by subtracting the intermittent transporting distance L from the maintenance work period moving distance.

Also, in S107, when the medium 7 is transported in the transporting direction so that the maintenance work period moving distance becomes the intermittent transporting distance L, the printing on the medium 7 restarts in S108.

In S105, presumably, in a case in which the recording head 34 is determined to be not recovered to the normal state (in a case in which determination is N), S111 is performed. In S111, the CPU 13 causes the counter 17 to count up the count value n in from two to three.

Since the count value n in S111 is counted up to three, the count value n in S112 is determined to be equal to or more than three (Y), and S113 is performed.

In S113, the CPU 13 determines that the recording head 34 is not easily recovered to the normal state by the maintenance work of S104, and causes the display unit 111 to display an error (failure) message. Also, when the error message is displayed on the display unit 111, a worker performs a work for solving the error (for example, exchanging recording head 34).

In the embodiment, a case in which an upper limit value of the number of the maintenance works being performed in S104 is three is exemplified, but the upper limit value of the number of the maintenance works being performed in S104 can be changed. That is, the upper limit value of the number of the maintenance works being performed in S104 is not limited to three, and may be greater than three, or may be smaller than three.

Next, with reference to FIGS. 6A to 6G, a state of the medium 7 in the maintenance work (a state in which the medium 7 is transported) will be described.

Moreover, in FIGS. 6A to 6G, in order to easily understand the state of the medium 7, the images B and C of one frame are formed on six regions (six regions of the regions B1, B2, B3, B4, B5, and B6, and the regions C1, C2, C3, C4, C5, and C6) of the medium 7. That is, the image B of one frame is formed on the regions B1, B2, B3, B4, B5, and B6 of the medium 7, and the image C of one frame is formed on the regions C1, C2, C3, C4, C5, and C6 of the medium 7.

In addition, a length of the regions B1, B2, B3, B4, B5, and B6 of the medium 7 in the transporting direction, and a length of the regions C1, C2, C3, C4, C5, and C6 of the medium 7 in the transporting direction are respectively (1/6)×the intermittent transporting distance L.

Figure 6A:
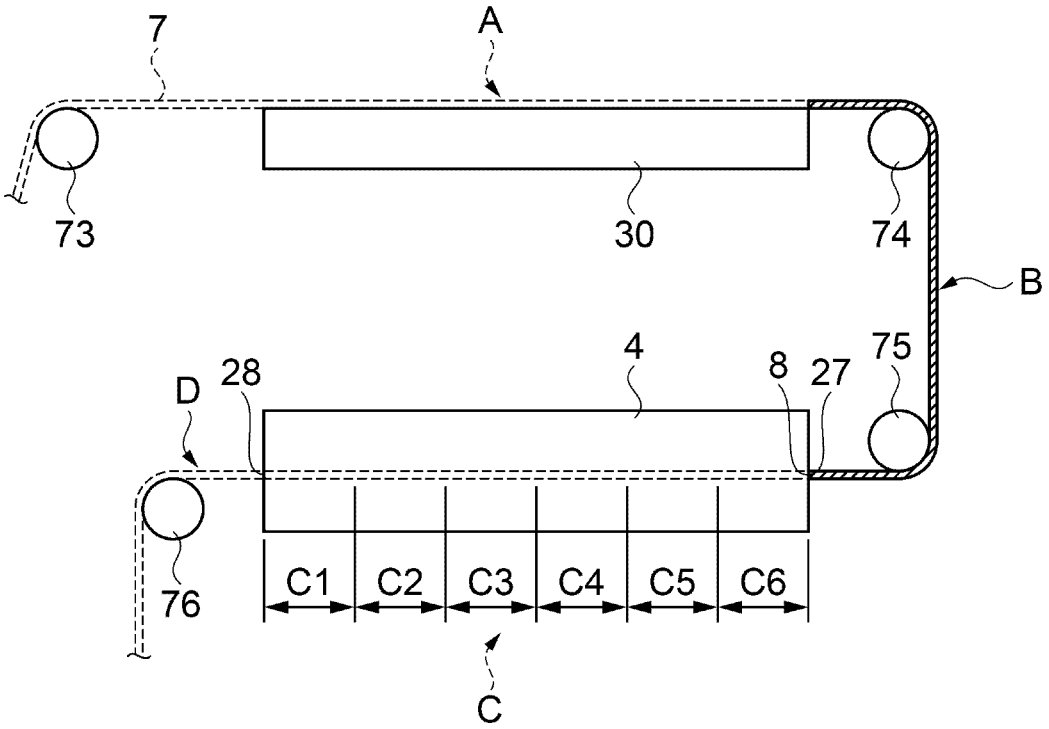
FIG. 6A is a schematic view illustrating a state of transportation of the medium in a transporting process of the medium.
Figure 7:
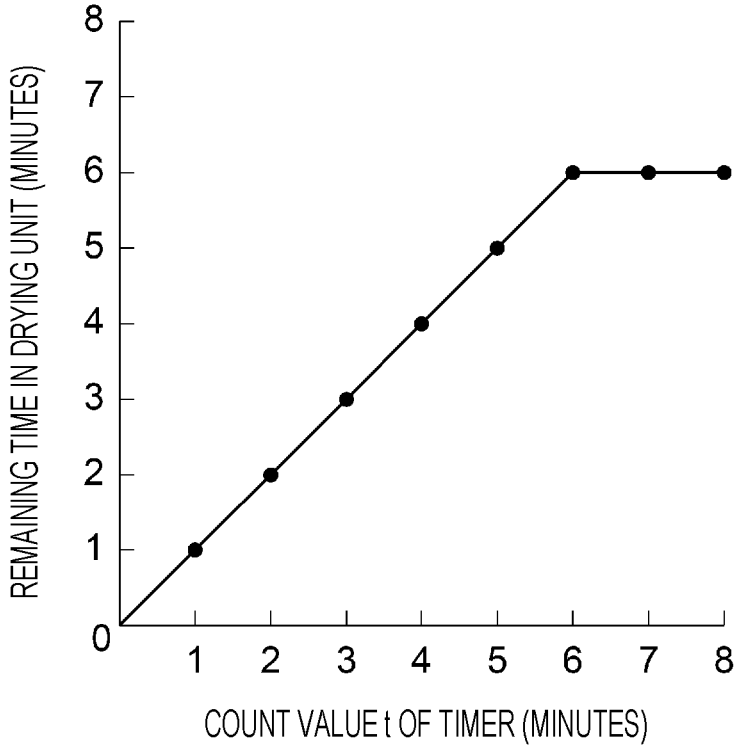
FIG. 7 is a graph illustrating how long a medium remains in the drying unit in a case in which the transporting process of the medium is performed.

The medium 7 starts to be transported in S103 in the state of FIG. 6A. In detail, as illustrated in FIG. 6A, in the state in which the image B of one frame (the regions B1, B2, B3, B4, B5, and B6 of the medium 7) is disposed between the drying unit 4 and the platen 30, and the image C of one frame (the regions C1, C2, C3, C4, C5, and C6 of the medium 7) is disposed in the drying unit 4, the transporting process of the medium 7 in S103 starts.

Figure 6B:
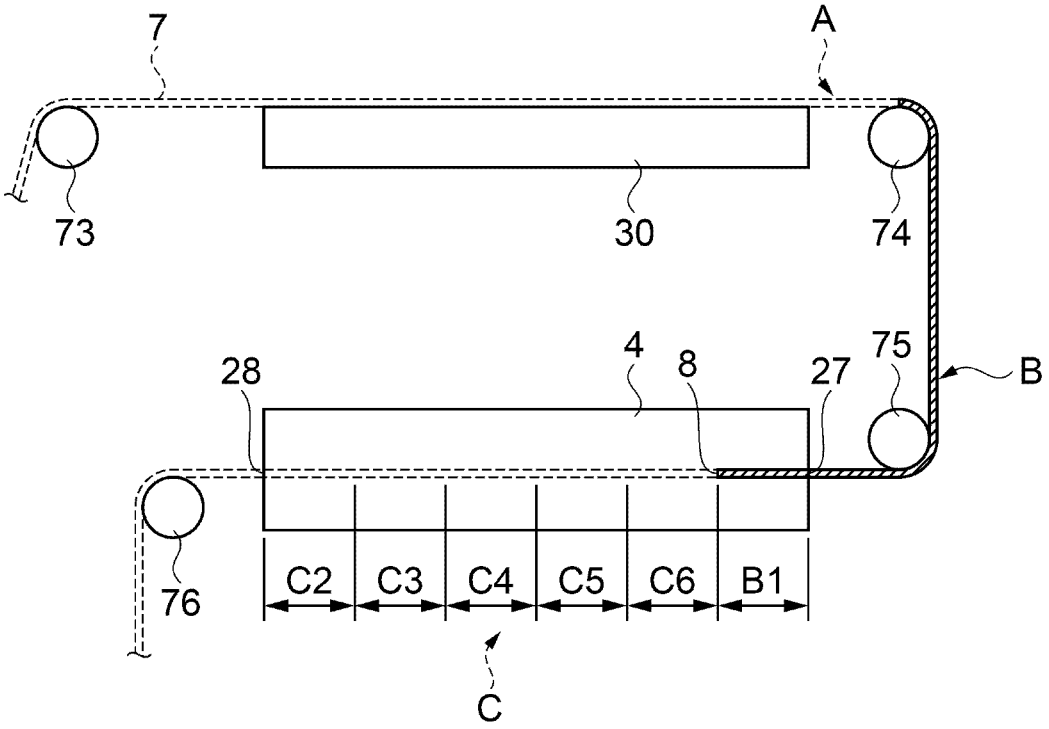
FIG. 6B is a schematic view illustrating the state of transportation of the medium in the transporting process of the medium.

In a case in which the count value t is in a range of zero to one minute, the medium 7 is transported so that the maintenance work period moving distance becomes (1/6)× the intermittent transporting distance L, and the medium 7 is stopped to be transported when the maintenance work period moving distance becomes (1/6)×the intermittent transporting distance L. Also, as illustrated in FIG. 6B, the medium 7 is transported by a distance corresponding to (1/6)×the intermittent transporting distance L, and the region B1 of the medium 7 and the regions C2, C3, C4, C5, and C6 of the medium 7 are disposed in the drying unit 4.

Figure 6C:
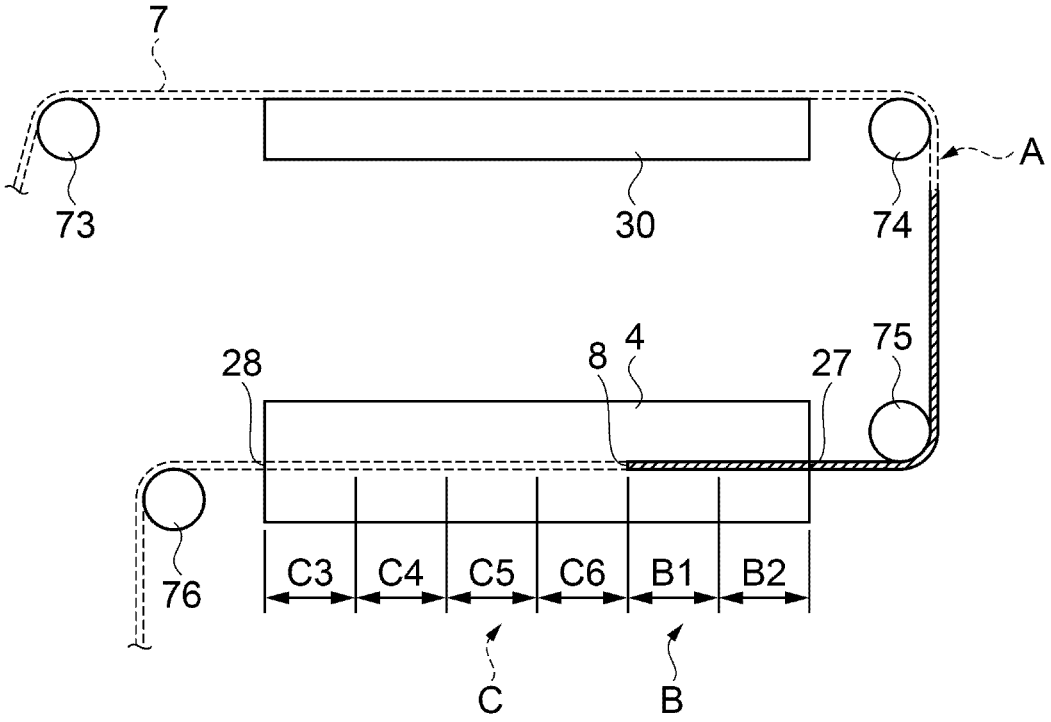
FIG. 6C is a schematic view illustrating the state of transportation of the medium in the transporting process of the medium.

In a case in which the count value t is in a range of one minute to two minutes, the medium 7 is transported so that the maintenance work period moving distance becomes (2/6)×the intermittent transporting distance L, and the medium 7 is stopped to be transported when the maintenance work period moving distance becomes (2/6)×the intermittent transporting distance L. Also, as illustrated in FIG. 6C, the medium 7 is transported by a distance corresponding to (2/6)×the intermittent transporting distance L, and the regions B1 and B2 of the medium 7 and the regions C3, C4, C5, and C6 of the medium 7 are disposed in the drying unit 4.

Figure 6D:
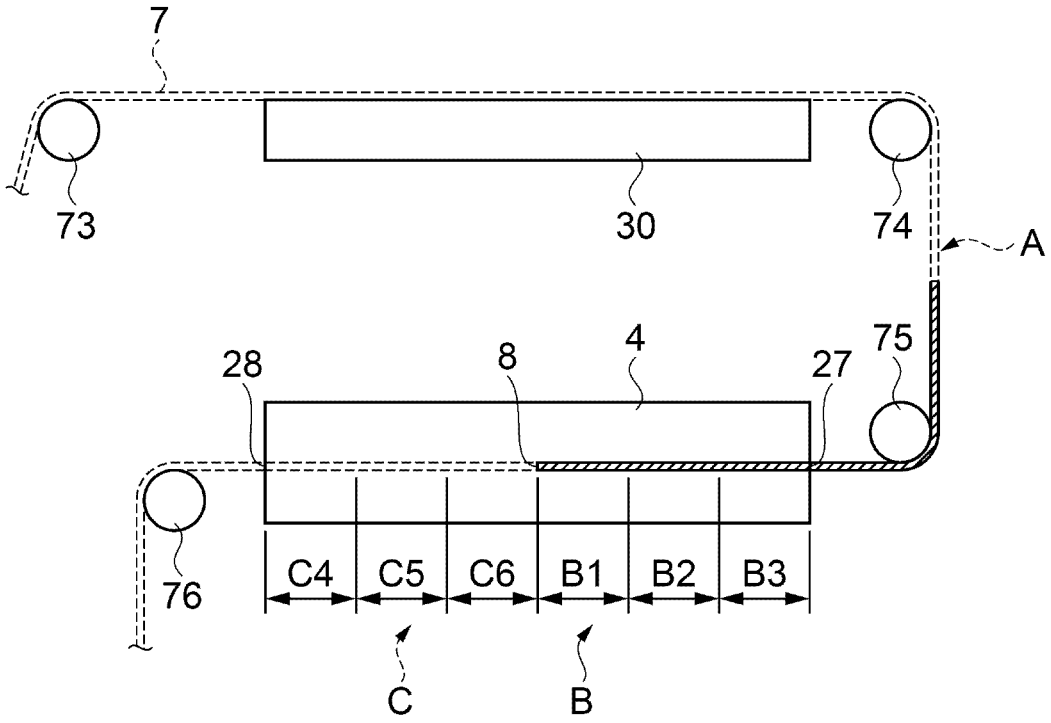
FIG. 6D is a schematic view illustrating the state of transportation of the medium in the transporting process of the medium.

In a case in which the count value t is in a range of two minutes to three minutes, the medium 7 is transported so that the maintenance work period moving distance becomes (3/6)×the intermittent transporting distance L, and the medium 7 is stopped to be transported when the maintenance work period moving distance becomes (3/6)×the intermittent transporting distance L. Also, as illustrated in FIG. 6D, the medium 7 is transported by a distance corresponding to (3/6)×the intermittent transporting distance L, and the regions B1, B2, and B3 of the medium 7 and the regions C4, C5, and C6 of the medium 7 are disposed in the drying unit 4.

Figure 6E:
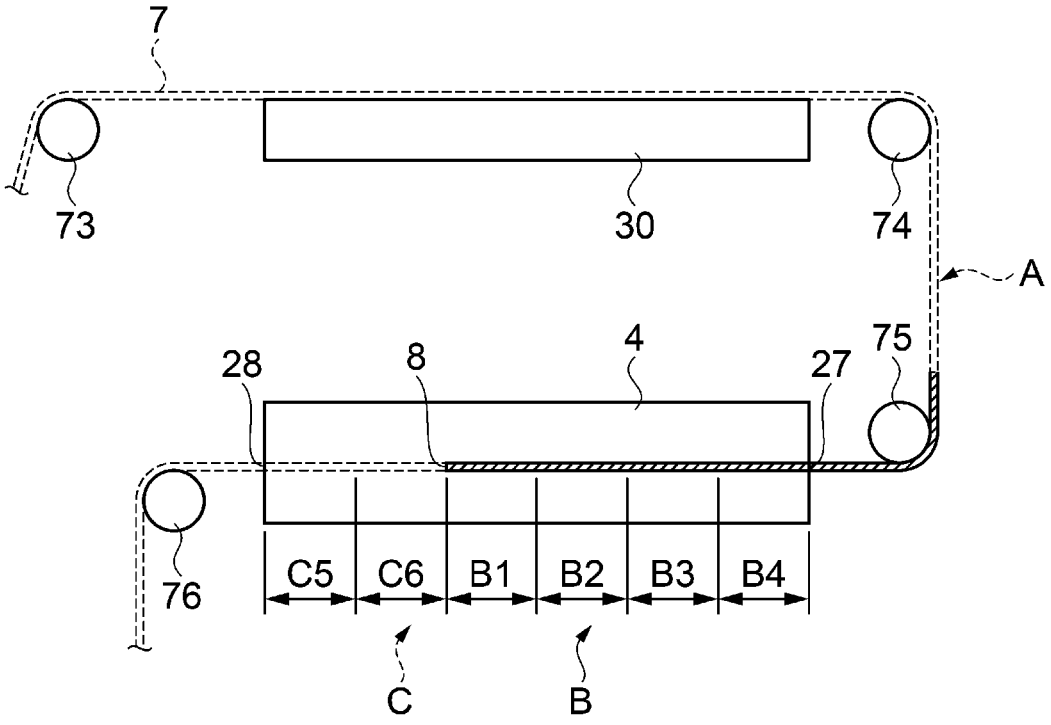
FIG. 6E is a schematic view illustrating the state of transportation of the medium in the transporting process of the medium.

In a case in which the count value t is in a range of three minutes to four minutes, the medium 7 is transported so that the maintenance work period moving distance becomes (4/6)×the intermittent transporting distance L, and the medium 7 is stopped to be transported when the maintenance work period moving distance becomes (4/6)×the intermittent transporting distance L. Also, as illustrated in FIG. 6E, the medium 7 is transported by a distance corresponding to (4/6)×the intermittent transporting distance L, and the regions B1, B2, B3, and B4 of the medium 7 and the regions C5, and C6 of the medium 7 are disposed in the drying unit 4.

Figure 6F:
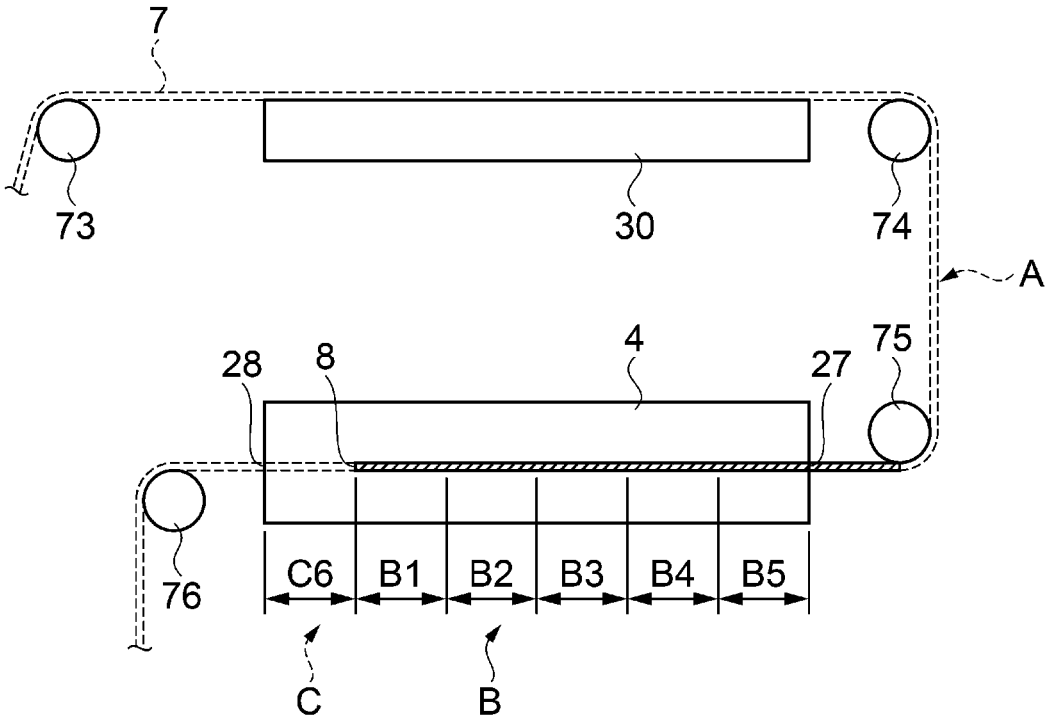
FIG. 6F is a schematic view illustrating the state of transportation of the medium in the transporting process of the medium.

In a case in which the count value t is in a range of four minutes to five minutes, the medium 7 is transported so that the maintenance work period moving distance becomes (5/6)×the intermittent transporting distance L, and the medium 7 is stopped to be transported when the maintenance work period moving distance becomes (5/6)×the intermittent transporting distance L. Also, as illustrated in FIG. 6F, the medium 7 is transported by a distance corresponding to (5/6)×the intermittent transporting distance L, and the regions B1, B2, B3, B4, and B5 of the medium 7 and the region C6 of the medium 7 are disposed in the drying unit 4.

Figure 6G:
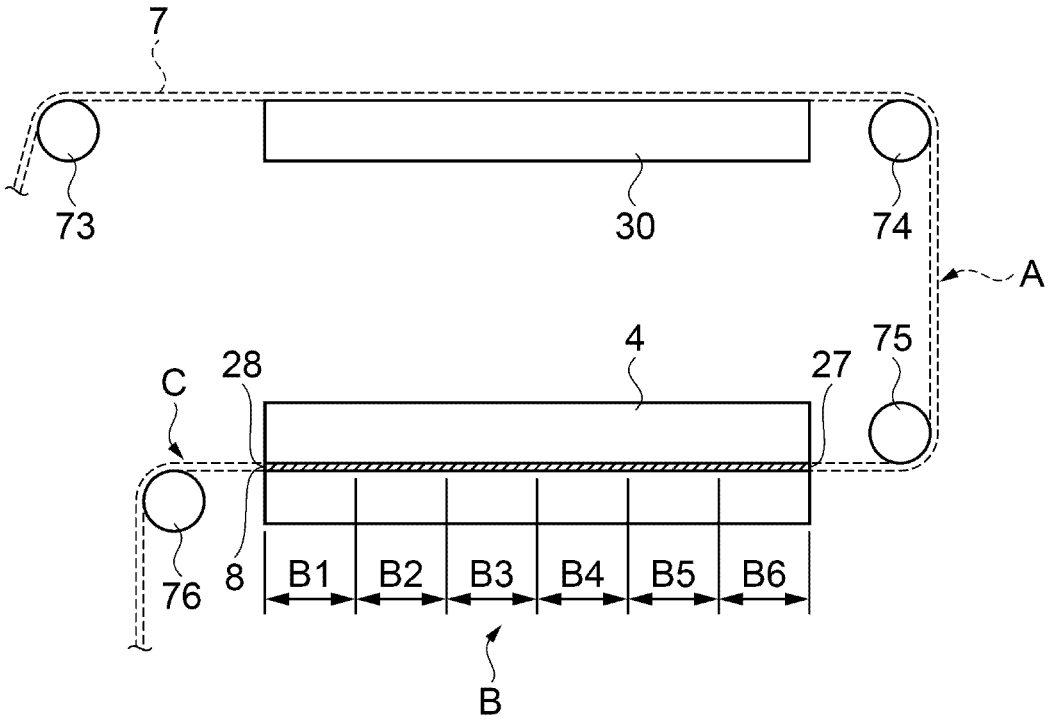
FIG. 6G is a schematic view illustrating the state of transportation of the medium in the transporting process of the medium.

In a case in which the count value t is in a range of five minutes to six minutes, the medium 7 is transported so that the maintenance work period moving distance becomes (6/6)×the intermittent transporting distance L, and the medium 7 is stopped to be transported when the maintenance work period moving distance becomes (6/6)×the intermittent transporting distance L. Also, as illustrated in FIG. 6G, the medium 7 is transported by a distance corresponding to (6/6)×the intermittent transporting distance L, and the regions B1, B2, B3, B4, B5, and B6 of the medium 7 are disposed in the drying unit 4.

Further, in a case in which the count value t exceeds six minutes, the intermittent transportation which is a transportation by the distance corresponding to (1/6)×the intermittent transporting distance L is repeated in a one minute cycle.

A reference numeral 8 in FIGS. 6A to 6G indicates an end 8 on the bring-in port 27 side of the region B1 of the medium 7 before starting of S103 (the transporting process of the medium 7), and hereinafter, is referred to as the end 8 of the medium 7.

FIG. 7 corresponds to a perspective view illustrating how long the end 8 of the medium 7 remains in the drying unit 4 in a case in which S103 (transporting process of medium 7) is performed.

When the transporting process of the medium 7 in S103 starts, the end 8 of the medium 7 is directly transported in the drying unit 4, and is brought out to the outside of the drying unit 4 through the states of FIGS. 6B to 6G. Also, the end 8 of the medium 7 is disposed in the drying unit 4 when the count value t is in a range of zero to six minutes, but is discharged to the outside of the drying unit 4 when the count value t exceeds six minutes.

As illustrated in FIG. 7, when the count value t is in a range of zero to six minutes, if the count value t is increased, a remaining time of the end 8 of the medium 7 in the drying unit 4 is also increased. Also, the remaining time of the end 8 of the medium 7 in the drying unit 4 is a maximum of six minutes.

If the count value t exceeds six minutes, since the end 8 of the medium 7 is discharged to the outside of the drying unit 4, the remaining time of the end 8 of the medium 7 in the drying unit 4 is not increased more than six minutes, and the remaining time of the end 8 of the medium 7 in the drying unit 4 is limited to six minutes.

For example, in a case in which the recording head 34 is recovered to the normal state by the first maintenance work, the remaining time of the end 8 of the medium 7 in the drying unit 4 is three minutes which is equal to the required time taken from the first maintenance work to the first AID inspection (three minutes).

For example, in a case in which the recording head 34 is recovered to the normal state by the second maintenance work, the remaining time of the end 8 of the medium 7 in the drying unit 4 is six minutes which is equal to the required time taken from the first maintenance work to the second AID inspection (six minutes).

In the embodiment, the recording head 34 is recovered to the normal state by the third maintenance work, and the required time taken from the first maintenance work to the third AID inspection is nine minutes. During the first maintenance work to the third AID inspection, the transporting process of the medium 7 (S103) is performed, and thus the remaining time of the end 8 of the medium 7 in the drying unit 4 is not increased more than six minutes, and the remaining time of the end 8 of the medium 7 in the drying unit 4 is limited to six minutes.

Further, even in a case in which the recording head 34 is recovered to the normal state by the maintenance work which is performed more than three times, the remaining time of the end 8 of the medium 7 in the drying unit 4 is not increased more than six minutes, and the remaining time of the end 8 of the medium 7 in the drying unit 4 is limited to six minutes.

The remaining time of the end 8 of the medium 7 in the drying unit 4 can be applied to the medium 7 being disposed on an upstream side of the bring-in port 27 in the transporting direction. For example, a time when the medium 7 on the region where the image B of one frame is formed and the medium 7 on the region where the image A of one frame is formed remain in the drying unit 4 is the same as the remaining time of the end 8 of the medium 7 in the drying unit 4. Therefore, the time when the medium 7 being disposed on the upstream side of the bring-in port 27 in the transporting direction remains in the drying unit 4 is limited to a maximum of six minutes.

Meanwhile, since the medium 7 being disposed on a downstream side of the bring-in port 27 in the transporting direction is brought out to the outside of the drying unit 4 faster than the end 8 of the medium 7, a time when the medium 7 being disposed on the downstream side of the bring-in port 27 in the transporting direction remains in the drying unit 4 becomes shorter than six minutes.

Further, in a printing method of the printing apparatus 100 according to the embodiment, in a case in which the printing is temporarily stopped, and the predetermined maintenance work (interruption work) is performed, in a period from performing of S101 to determination of Y in S105 (an interruption work period from starting the interruption work to finishing the interruption work), or in a partial period from performing of S101 to determination of Y in S105 (the interruption work period from the starting the interruption work to finishing the interruption work), the medium 7 is transported in the direction toward the bring-out port 28 from the bring-in port 27, and then the printing on the medium 7 restarts.

In the embodiment, since the transporting process of the medium 7 is performed in S103 in the period from the starting of S104 (maintenance work) to the determination of Y in S105 (AID inspection), the maximum of the remaining time of the medium 7 in the drying unit 4 is controlled to be equal to or less than six minutes. Further, even when the heating process is performed on the medium 7 for six minutes in the drying unit 4, the heating process temperature of the drying unit 4 is set to be a temperature (75° C.) at which a thermal damage is not easily generated in the medium 7.

Therefore, in the printing apparatus 100 according to the embodiment, and the printing method of the printing apparatus 100 according to the embodiment, in a case in which the printing is temporarily stopped and the maintenance work is performed, since the maximum of the remaining time of the medium 7 in the drying unit 4 is controlled to be equal to or less than six minutes or less, it is possible to exhibit an effect in which the thermal damage such as wrinkles is not easily generated in the medium 7 due to the heating process in the drying unit 4.

Embodiment 2

Figure 8:
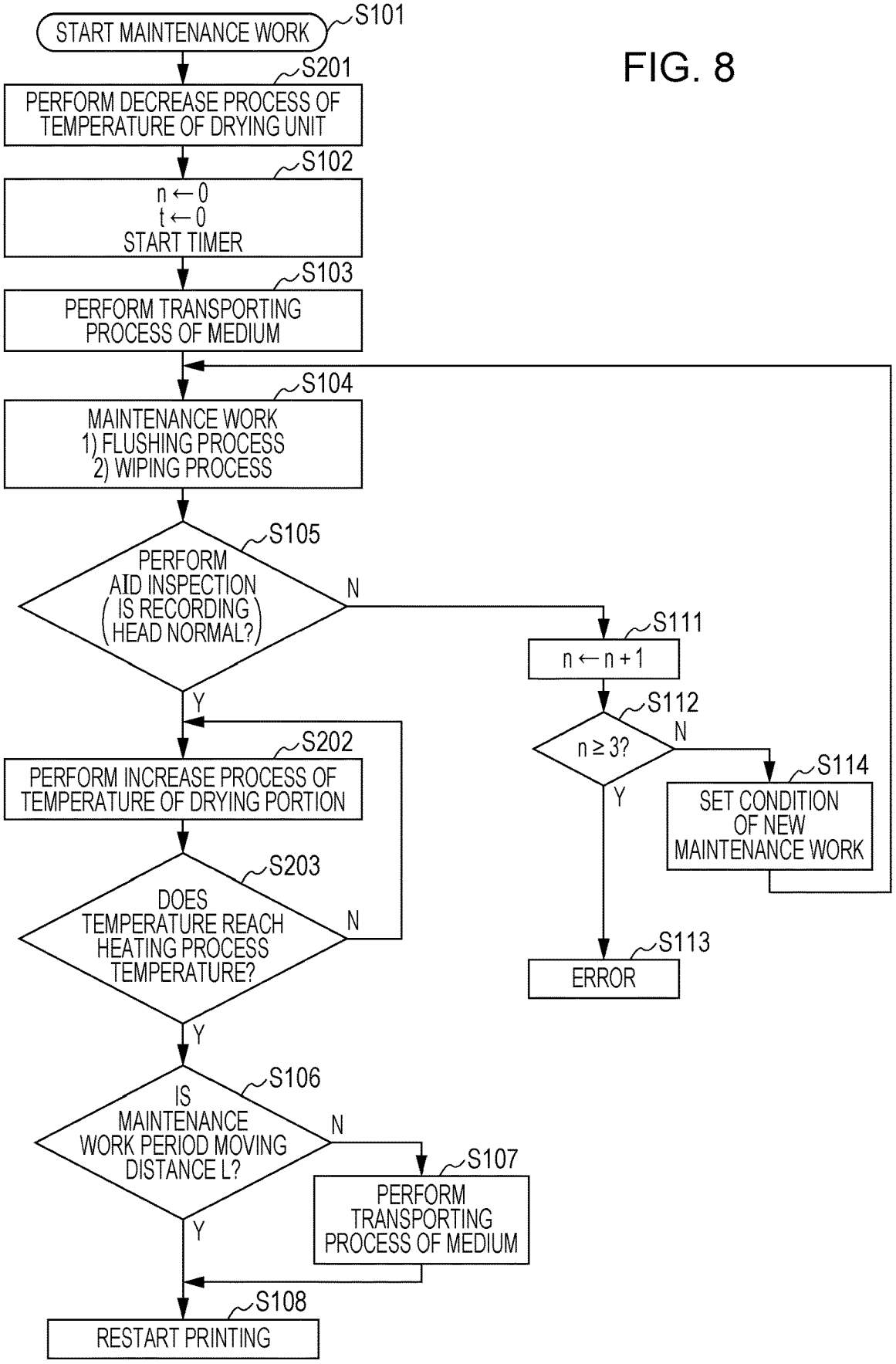
FIG. 8 is a flow chart illustrating a second control method of a printing apparatus according to Embodiment 2.
Figure 9:
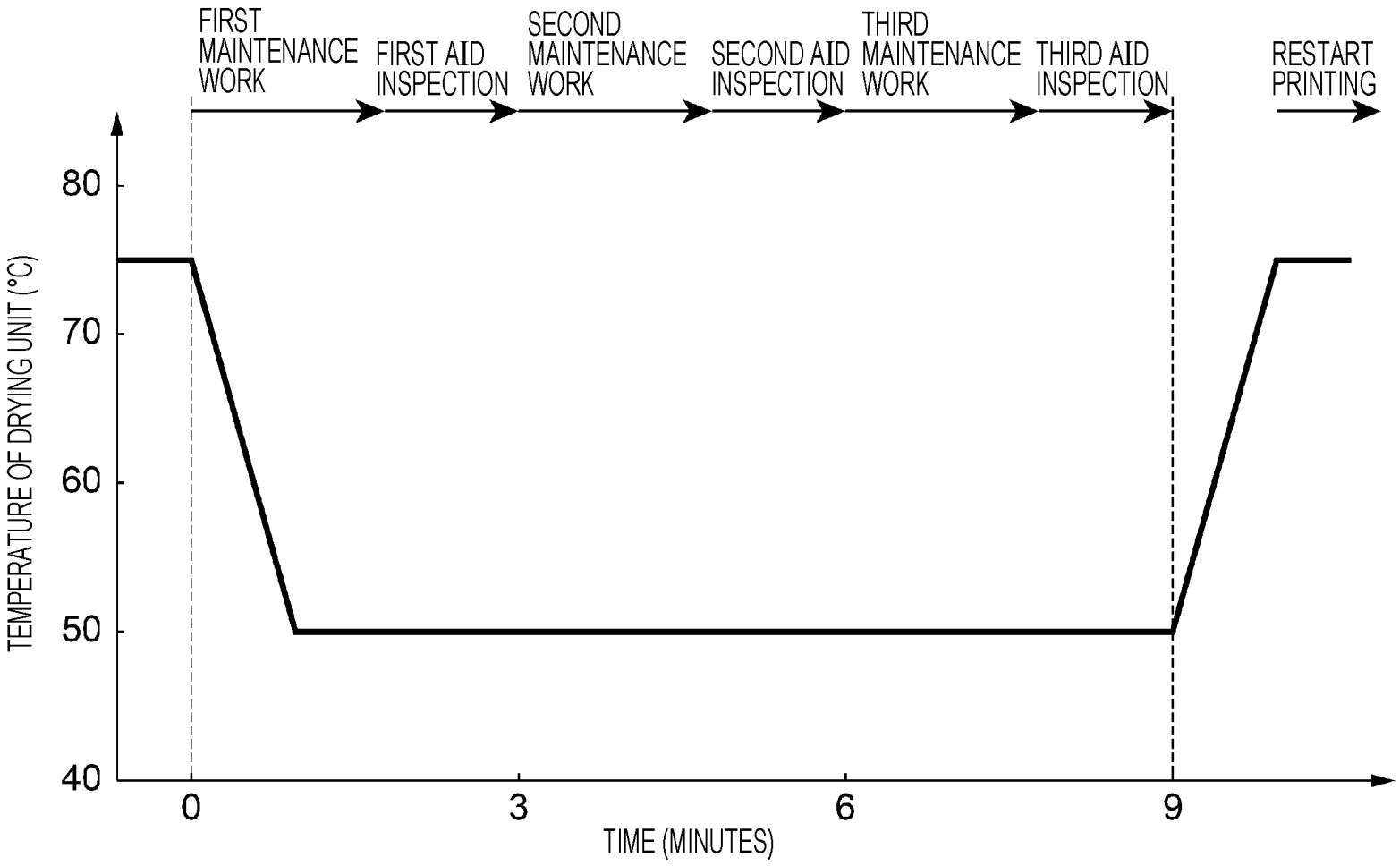
FIG. 9 is a view illustrating a state of a temperature of the drying unit in a case in which the second control method is performed.
Figure 10:
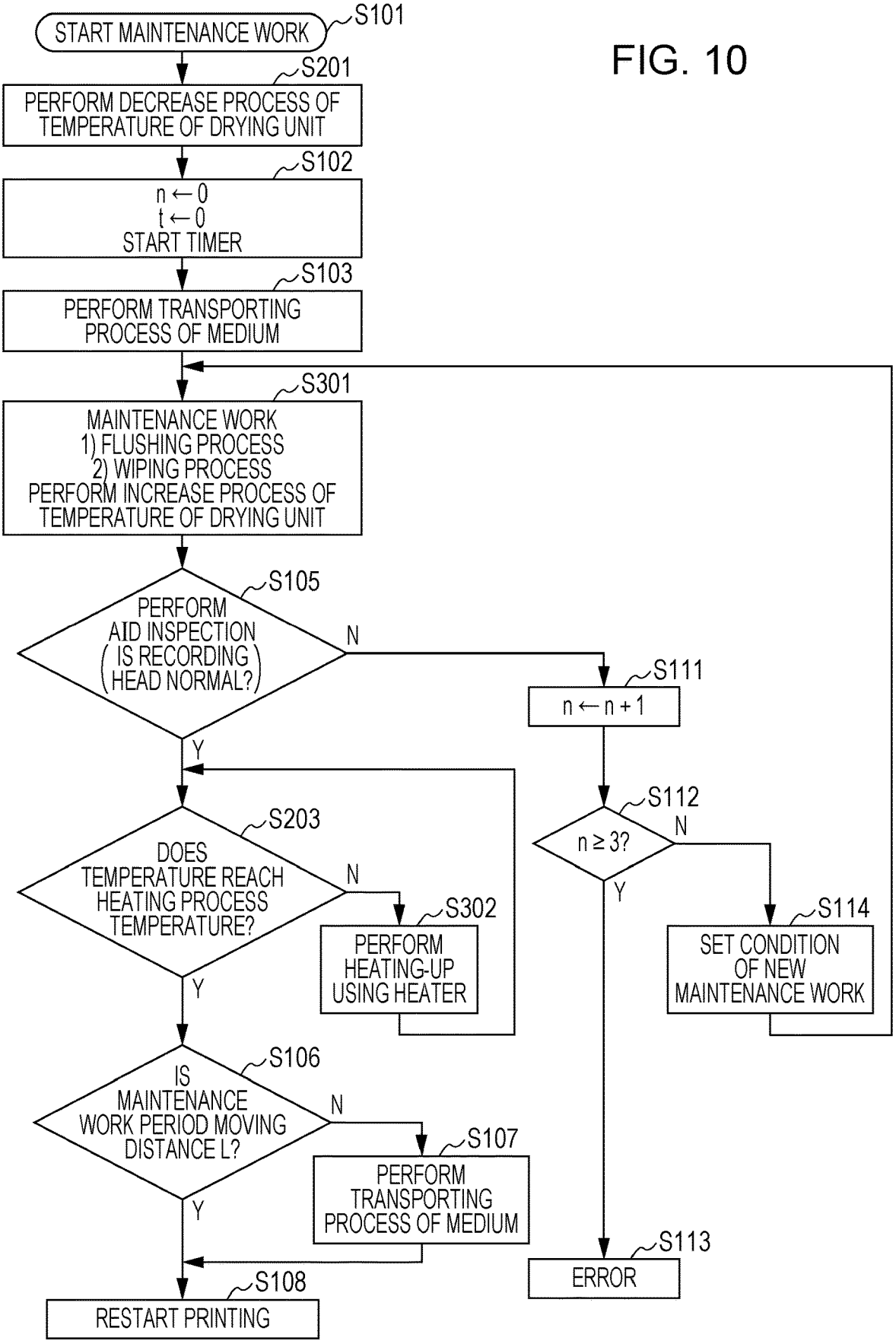
FIG. 10 is a flow chart illustrating a third control method of the printing apparatus according to the embodiment.
Figure 11:
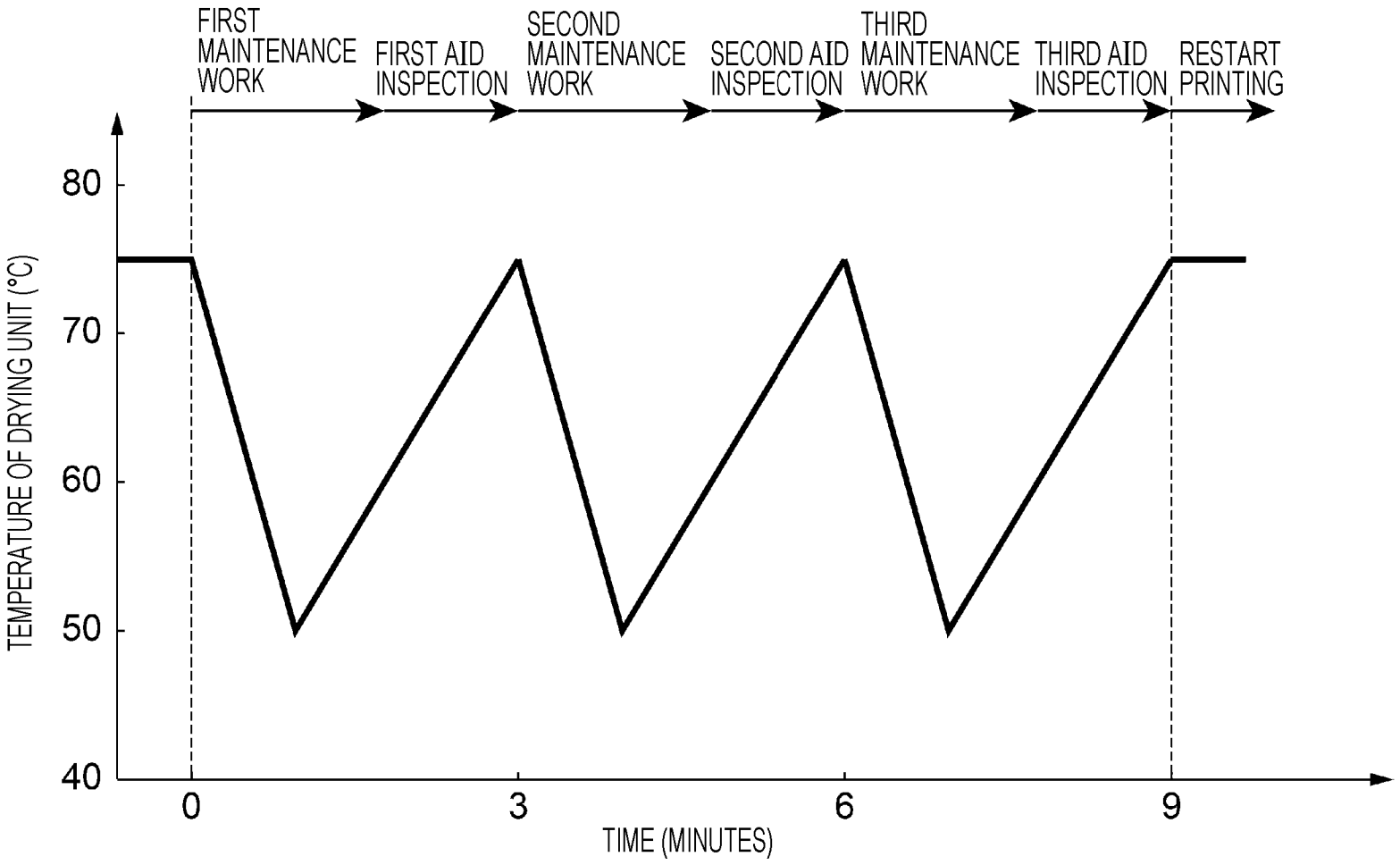
FIG. 11 is a view illustrating a state of the temperature of the drying unit in a case in which the third control method is performed.

FIG. 8 is a flow chart illustrating a second control method of a printing apparatus according to Embodiment 2. FIG. 9 is a view illustrating a state of a temperature of the drying unit in a case in which the second control method is performed. FIG. 10 is a flow chart illustrating a third control method of the printing apparatus according to the embodiment. FIG. 11 is a view illustrating a state of a temperature of the drying unit in a case in which the third control method is performed.

In addition, in FIGS. 9 and 11, the temperature of the drying unit 4 is illustrated on a vertical axis, and the time is illustrated on a horizontal axis. Further, FIGS. 9 and 11 schematically illustrate the state of the printing apparatus 100 (maintenance work, AID inspection, and restarting of printing) corresponding to the elapsed time in the horizontal axis. Moreover, regarding the state of the printing apparatus 100 (maintenance work, AID inspection, and restarting of printing) corresponding to the elapsed time in the horizontal axis in FIGS. 9 and 11, a length of a horizontal axis direction does not correspond to a required time taken for an actual maintenance work or a required time taken for an actual AID inspection. That is, FIGS. 9 and 11 illustrate a state of the printing apparatus 100 which corresponds to the temperature of the drying unit 4.

The printing apparatus according to this embodiment includes the same configuration as that of the printing apparatus 100 according to Embodiment 1, but a control method according to this embodiment is different from that of Embodiment 1. In detail, the control method of the printing apparatus according to the embodiment includes a second control method different from the first control method, and a third control method different from the first control method, in addition to the first control method same as the control method of the printing apparatus 100 according to Embodiment 1. Moreover, the second control method is an example of a "first mode", and hereinafter, is referred to as the first mode. The third control method is an example of a "second mode", and hereinafter, is referred to as the second mode.

In addition, in the embodiment, in the same manner as Embodiment 1, the maintenance work causing the recording head 34 to be recovered to the normal state is performed three times, and the recording head 34 is recovered to the normal state by the third maintenance work.

In the printing apparatus according to the embodiment, in addition to an icon for selecting the first control method, an icon for selecting the first mode and an icon for selecting the second mode are provided on the display unit 111. A worker can select any one of the first control method, the first mode, and the second mode by touching the icons on the display unit 111.

First, with reference to FIGS. 8 and 9, differences of the second control method (first mode) of the printing apparatus according to the embodiment from those of Embodiment 1 will be mainly described. Moreover, since the first control method of the printing apparatus according to the embodiment is the same as the control method of the printing apparatus 100 according to Embodiment 1 (refer to FIG. 5), description thereof will be omitted. Further, in the second control method (first mode) illustrated in FIG. 8, the same reference numeral is given to the same step as that of the first control method (control method of printing apparatus 100 illustrated in FIG. 5), and description to be overlapped with each other is omitted.

As illustrated in FIG. 8, in the first mode, in the case in which generation of defective nozzles in the nozzles 35 of the recording head 34 is recognized by the AID inspection, the case in which the use of the recording head 34 reaches a predetermined condition, a case in which a defect is generated in an image printed on the medium 7, or the like, the printing performed on the medium 7 is temporarily stopped, the maintenance work starts (S101).

Moreover, in this disclosure "after the starting the interruption work" corresponds to after S101 (maintenance work starts) is performed.

Subsequently, S201 is performed. In S201, the CPU 13 performs a control of electric connection to the heater 52 or a temperature control of the heater 52 and causes the temperature of the drying unit 4 to be decreased. That is, in the embodiment, after S101 is performed (after the starting the interruption work), S201 (a process of the decrease of the temperature of the drying unit 4) is performed. Then, when the temperature of the drying unit 4 is decreased to 50° C. (standby temperature) from 75° C. (heating process temperature), and the temperature of the drying unit 4 reaches 50° C. (standby temperature), the temperature of the drying unit 4 is maintained at 50° C. (standby temperature) (refer to FIG. 9).

That is, in S201, after S101 is performed (after the starting the interruption work), the control of electric connection to the heater 52 or the temperature control of the heater 52 is performed so that the temperature of the drying unit 4 becomes the standby temperature (50° C.) which is lower than the temperature (heating process temperature: 75° C.) at the time of starting the maintenance work.

Moreover, S201 (a decreasing process of the temperature of the drying unit 4) may be performed with S103 (the transporting process of the medium 7) at the same time, or may be performed after S103 (the transporting process of the medium 7).

Subsequently, through S102 (initial setting of count values n and t, and starting of timer), S103 (the transporting process of the medium 7), S104 (maintenance work), and S105 (AID inspection), in a case in which determination is Y in S105 (AID inspection), S202 is performed. Moreover, in a case in which the recording head 34 is determined to be not recovered to the normal state in S105 (in a case in which determination is N in S105), S111 is performed.

In the embodiment, the recording head 34 is recovered to the normal state by three times of the maintenance work (S104). That is, determination is Y in the third AID inspection (S105) through the third maintenance work (S104), S202 is performed.

In S202, the CPU 13 performs the control of electric connection to the heater 52 or the temperature control of the heater 52 and causes the temperature of the drying unit 4 to be increased. Then, the temperature of the drying unit 4 is increased to the heating process temperature (75° C.) at which ink is dried and fixed to the medium 7 from the standby temperature (50° C.)

Subsequently, in S203, the CPU 13 evaluates whether or not the temperature of the drying unit reaches the heating process temperature (75° C.)

In a case in which the CPU evaluates that the temperature of the drying unit 4 reaches the heating process temperature (75° C.) in S203 (in a case in which determination is Y in S203), the CPU 13 performs the control of electric connection to the heater 52 or the temperature control of the heater 52, and causes the temperature of the drying unit 4 to be maintained at the heating process temperature (75° C.)

In a case in which the CPU evaluates that the temperature of the drying unit 4 does not reach the heating process temperature in S203 (in a case in which determination is N in S203), S202 is continuously performed, and in a case in which the temperature of the drying unit 4 reaches the heating process temperature (75° C.), the CPU 13 performs the control of electric connection to the heater 52 or the temperature control of the heater 52, and causes the temperature of the drying unit 4 to be maintained at the heating process temperature (75° C.)

When the temperature of the drying unit 4 is maintained at the heating process temperature (75° C.), S106 is performed. In S106, the CPU 13 evaluates whether or not the maintenance work period moving distance is the intermittent transporting distance L. Also, in a case in which the maintenance work period moving distance is the intermittent transporting distance L in S106 (in a case in which determination is Y in S106), S108 is performed, and the printing on the medium 7 restarts.

In a case in which determination is N in S106 and the maintenance work period moving distance becomes shorter than the intermittent transporting distance L, in S107, the CPU 13 controls the sheet transporting system, and causes the medium 7 to be further transported in the transporting direction (the direction toward the bring-out port 28 from the bring-in port 27) by the difference distance obtained by subtracting the maintenance work period moving distance from the intermittent transporting distance L.

In a case in which determination is N in S106 and the maintenance work period moving distance becomes longer than the intermittent transporting distance L, in S107, the CPU 13 controls the sheet transporting system, and causes the medium 7 to be further transported in an opposite direction to the transporting direction (the direction toward the bring-in port 27 from the bring-out port 28) by the difference distance obtained by subtracting the intermittent transporting distance L from the maintenance work period moving distance.

Also, When the medium 7 is transported in the transporting direction so that the maintenance work period moving distance becomes the intermittent transporting distance L, the printing on the medium 7 restarts in S108.

Moreover, S202 (an increase of the temperature of the drying unit 4) may be performed with S106 (the evaluation of the maintenance work period moving distance) at the same time, or may be performed after S106 (the evaluation of the maintenance work period moving distance). Further, S106 (the evaluation of the maintenance work period moving distance) may be performed with S203 (the evaluation of the temperature of the drying unit) at the same time, or may be performed before S203 (the evaluation of temperature of the drying unit).

As illustrated in FIG. 9, after S101 is performed (after starting the interruption work), the temperature of the drying unit 4 is decreased, and the temperature of the drying unit 4 reaches 50° C. (standby temperature) during the first maintenance work. When the temperature of the drying unit 4 reaches 50° C. (standby temperature), the temperature of the drying unit 4 is maintained at 50° C. (standby temperature) until the third AID inspection (S105) in which the recording head 34 is determined to be recovered to the normal state is finished.

Also, after the recording head 34 is determined to be recovered to the normal state in S105, the temperature of the drying unit 4 is continuously increased until the temperature of the drying unit 4 is increased and the temperature of the drying unit 4 reaches 75° C. (heating process temperature). That is, after S101 is performed (after the starting the interruption work), the temperature of the drying unit 4 is decreased by performing the control of electric connection to the heater 52 or the temperature control of the heater 52, and after the third maintenance work is finished (in detail, after the third AID inspection is finished), the temperature of the drying unit 4 is increased by performing the control of electric connection to the heater 52 or the temperature control of the heater 52. Also, when the temperature of the drying unit 4 reaches 75° C. (heating process temperature) and is maintained at 75° C. (heating process temperature), the printing on the medium 7 restarts.

For example, in a case in which the recording head 34 is recovered to the normal state by only the first maintenance work, in the first mode, after S101 is performed (after the starting the interruption work), the temperature of the drying unit 4 is decreased by performing the control of electric connection to the heater 52 or the temperature control of the heater 52 of the drying unit 4, the temperature of the drying unit 4 is maintained at 50° C. (standby temperature) after the temperature of the drying unit 4 reaches 50° C. (standby temperature), and the temperature of the drying unit 4 is increased by performing the control of electric connection to the heater 52 or the temperature control of the heater 52 of the drying unit 4 after the first maintenance work.

That is, in the first mode, in a case in which the printing is temporarily stopped, and the first maintenance work set in advance is performed, after S101 is performed (after the starting the interruption work), the temperature of the drying unit 4 is decreased by performing the control of electric connection to the heater 52 or the temperature control of the heater 52 of the drying unit 4 is performed, and the temperature of the drying unit 4 is increased by performing the control of electric connection to the heater 52 or the temperature control of the heater 52 of the drying unit 4 after the first maintenance work.

Further, in the first mode, after the first maintenance work starts, the control of electric connection to the heater 52 or the temperature control of the heater 52 is performed so that the temperature of the drying unit 4 becomes the standby temperature (50° C.) which is lower than a temperature (heating process temperature (75° C.)) at the time of starting the first maintenance work.

For example, in a case in which the recording head 34 is less likely to be recovered to the normal state by only the first maintenance work, and a new maintenance work is further performed continuing the first maintenance work, in the first mode, the control of electric connection to the heater 52 or the temperature control of the heater 52 is performed so that a temperature of 50° C. (standby temperature) is maintained even during the new maintenance work, and after the new maintenance work is finished, the temperature of the drying unit 4 is increased by performing the control of electric connection to the heater 52 or the temperature control of the heater 52 of the drying unit 4.

Further, in a case in which a new maintenance work is repeatedly performed in many times, in the first mode, the temperature of the drying unit 4 is increased by performing the control of electric connection to the heater 52 or the temperature control of the heater 52 of the drying unit 4 after the last new maintenance work is finished. That is, in a case in which the new maintenance work is repeatedly performed, the temperature of the drying unit 4 is increased by performing the control of electric connection to the heater 52 or the temperature control of the heater 52 of the drying unit 4 after the last new maintenance work is finished.

In the first mode, in addition to the effect exhibited in Embodiment 1, it is possible to exhibit following effects.

1) In a case in which the maintenance work is performed, since the temperature of the drying unit 4 is lower than 75° C., compared to a case in which the temperature of the drying unit 4 is 75° C., the thermal damage such as wrinkles is not easily generated in the medium 7 remaining in the drying unit 4.

Moreover, during the first maintenance work and the third AID inspection, the standby temperature of the drying unit 4 is maintained at a temperature lower than 50° C., and thus the thermal damage such as wrinkles cannot be easily generated in the medium 7 remaining in the drying unit 4, compared to a case in which the temperature of the drying unit 4 is maintained at 50° C.

Next, with reference to FIGS. 10 and 11, differences of the third control method (second mode) of the printing apparatus according to the embodiment from the second control method (first mode) will be mainly described. Further, in the third control method (second mode) illustrated in FIG. 10, the same reference numeral is given to the same step as that of the second control method (first mode), and overlapping description will be omitted.

As illustrated in FIG. 10, in the second mode, the printing on the medium 7 is temporarily stopped, and through S101 (maintenance work starts), S201 (the decreasing process of the temperature of the drying unit 4), S102 (initial setting of count values n and t and starting of timer), and S103 (transporting process of medium 7), S301 is performed.

In S301, the CPU 13 controls the maintenance unit 9, and performs the first maintenance work. Moreover, the first maintenance work is performed in a case in which the count value n is set to zero (initial value), and the basic process constituted of the flushing process and the wiping process are performed two times.

Further, in S301, the temperature of the drying unit 4 is increased by performing the control of electric connection to the heater 52 or the temperature control of the heater 52 of the drying unit 4 during the first maintenance work.

That is, in the second mode, even in a case in which it is not confirmed that the recording head 34 is recovered to the normal state by the maintenance work, the temperature of the drying unit 4 is increased during the maintenance work. Meanwhile, in the first mode, after it is confirmed that the recording head 34 is recovered to the normal state by the maintenance work, the temperature of the drying unit 4 is increased. This point is a difference between the second mode and the first mode.

In other words, in the second mode, it is expected that the recording head 34 is recovered to the normal state by the maintenance work, the temperature of the drying unit 4 is increased faster than that of the first mode, and the temperature of the drying unit 4 reaches the heating process temperature (75° C.) faster than that of the first mode.

Subsequently, through S105 (AID inspection), in a case in which the recording head 34 is determined to be recovered to the normal state in S105 (determination is Y in S105), S203 is performed. Moreover, in a case in which the recording head 34 is determined to be not recovered to the normal state in S105 (determination is N in S105), S111 is performed.

In the embodiment, since the recording head 34 is recovered to the normal state by the third maintenance work (S301), determination is Y in the third AID inspection (S105) after the third maintenance work (S301) is performed, and S203 is performed.

Subsequently, in S203, the CPU 13 evaluates whether or not the temperature of the drying unit reaches the heating process temperature (75° C.). In a case in which the temperature of the drying unit 4 is evaluated to reach the heating process temperature in S203 (in a case in which determination is Y in S203), S106 is performed. Also, through S106

(evaluation of maintenance work period moving distance), the printing on the medium 7 restarts in S108.

In a case in which the temperature of the drying unit 4 is evaluated not to reach the heating process temperature in S203 (in a case in which determination is N in S203), heating-up by the heater 52 (an increasing process of the temperature of the drying unit 4) is performed in S302. When the temperature of the drying unit 4 reaches the heating process temperature (75° C.), the CPU 13 performs the control of electric connection to the heater 52 or the temperature control of the heater 52, and causes the temperature of the drying unit 4 to be maintained at the heating process temperature (75° C.). Also, through S106 (the evaluation of the maintenance work period moving distance), the printing on the medium 7 restarts in S108.

As illustrated in FIG. 11, after S101 is performed (after the starting the interruption work), the temperature of the drying unit 4 is decreased, and the temperature of the drying unit 4 is increased during the first maintenance work. That is, in a case in which determination is Y by the first AID inspection of S105, the printing on the medium 7 is possible to immediately restart, and the temperature of the drying unit 4 reaches 75° C. (heating process temperature) by performing the control of electric connection to the heater 52 or the temperature control of the heater 52 of the drying unit 4 after the first AID inspection of S105 is finished.

In the embodiment, in the first AID inspection, since the recording head 34 is determined not to be recovered to the normal state, in a case in which the first AID inspection is finished and the second maintenance work is performed, the temperature of the drying unit 4 is decreased, and the temperature of the drying unit 4 is increased during the second maintenance work.

That is, in a case in which determination is Y by the second AID inspection, the printing on the medium 7 is possible to immediately restart, and, the temperature of the drying unit 4 reaches 75° C. (heating process temperature) by performing the control of electric connection to the heater 52 or the temperature control of the heater 52 of the drying unit 4 after the second AID inspection is finished.

In the embodiment, even in the second AID inspection, since the recording head 34 is determined not to be recovered to the normal state, in a case in which the second AID inspection is finished and the third maintenance work is performed, the temperature of the drying unit 4 is decreased, and the temperature of the drying unit 4 is increased during the third maintenance work.

That is, in a case in which determination is Y by the third AID inspection of S105, the printing on the medium 7 is possible to immediately restart, and the temperature of the drying unit 4 reaches 75° C. (heating process temperature) by performing the control of electric connection to the heater 52 or the temperature control of the heater 52 of the drying unit 4 after the third AID inspection is finished.

In the embodiment, in the third AID inspection of S105, since the recording head 34 is determined to be recovered to the normal state, the temperature of the drying unit 4 reaches 75° C. (heating process temperature) at a time when the third AID inspection of S105 is finished, and the temperature of the drying unit 4 is maintained at 75° C. (heating process temperature).

Also, when the temperature of the drying unit 4 is maintained at 75° C. (heating process temperature), the printing on the medium 7 restarts.

For example, in a case in which the recording head 34 is recovered to the normal state by only the first maintenance work, in the second mode, after S101 is performed (after the starting the interruption work), the temperature of the drying unit 4 is decreased by performing the control of electric connection to the heater 52 or the temperature control of the heater 52, and the temperature of the drying unit 4 is increased by performing the control of electric connection to the heater 52 or the temperature control of the heater 52 of the drying unit 4 during the first maintenance work.

That is, in the second mode, in a case in which the printing is temporarily stopped and the predetermined first maintenance work is performed, the temperature of the drying unit 4 is decreased by performing the control of electric connection to the heater 52 or the temperature control of the heater 52 after S101 is performed (after the starting the interruption work), and the temperature of the drying unit 4 is increased by performing the control of electric connection to the heater 52 or the temperature control of the heater 52 of the drying unit 4 during the first maintenance work.

Further, in the second mode, the control of electric connection to the heater 52 or the temperature control of the heater 52 is performed so that the temperature of the drying unit 4 becomes a temperature (75° C.) before starting of the first maintenance work when S105 is finished (first AID inspection).

For example, in a case in which the recording head 34 is less likely to be recovered to the normal state by only the first maintenance work, and a new maintenance work is further performed continuing the first maintenance work, in the second mode, after the first AID inspection, the temperature of the drying unit 4 is decreased by performing the control of electric connection to the heater 52 or the temperature control of the heater 52, and the temperature of the drying unit 4 is increased by performing the control of electric connection to the heater 52 or the temperature control of the heater 52 of the drying unit 4 during the new maintenance work.

Further, in the second mode, new maintenance works (second maintenance work and third the third maintenance work) are repeatedly performed multiple times, the temperature of the drying unit 4 is increased by performing the control of electric connection to the heater 52 or the temperature control of the heater 52 of the drying unit 4 is performed so that the temperature of the drying unit 4 becomes 75° C. (heating process temperature) at the time of finishing the last new maintenance work (third maintenance work).

In the second mode, in addition to the effect exhibited in Embodiment 1, it is possible to exhibit following effects.

1) In a case in which the maintenance work is performed, since the temperature of the drying unit 4 is lower than the heating process temperature (75° C.), compared to a case in which the temperature of the drying unit 4 is the heating process temperature (75° C.), the thermal damage such as wrinkles is not easily generated in the medium 7.

2) In the second mode, it is expected that the recording head 34 is recovered to the normal state by the maintenance work, since the temperature of the drying unit 4 is increased faster than that of the first mode, and the temperature of the drying unit 4 reaches he heating process temperature (75° C.) faster than that of the first mode, it is possible to immediately restart the printing on the medium 7 faster than that of the first mode, and to reduce a loss generated due to a stop of the printing apparatus 100 caused by the maintenance work.

As described above, in the first mode, the temperature of the drying unit 4 is increased after recovering of the recording head 34 to the normal state by the maintenance work is confirmed, and in the second mode, the temperature of the drying unit 4 is increased during the maintenance work. Thus, in the first mode, compared to the second mode, the temperature of the drying unit 4 is lowered in a case in which the maintenance work is performed, and the thermal damage such as wrinkles is not easily generated in the medium 7.

Therefore, in the first mode, the thermal damage is not easily generated in the medium 7 compared to the second mode, and thus the first mode is suitable for the medium 7 in which the thermal damage is easily generated.

Meanwhile, in the second mode, compared to the first mode, the temperature of the drying unit 4 becomes high in a case in which the maintenance work is performed, and the thermal damage such as wrinkles is easily generated in the medium 7, but the temperature of the drying unit 4 quickly reaches 75° C. (heating process temperature), and thus there is an advantage that the printing on the medium 7 is possible to quickly restart.

Further, if the medium 7 is a medium in which the thermal damage is not easily generated, the thermal damage is not easily generated in the medium 7 even in the second mode. Therefore, the second mode is suitable for the medium 7 in which the thermal damage is not easily generated.

As described above, whether the first mode is performed or the second mode is performed is preferably chosen depending on the types of the medium 7.

Further, the printing apparatus according to the embodiment includes a configuration in which the temperature (standby temperature) at which the drying unit 4 is maintained after the decrease of the temperature can be varied depending on the types of the medium 7. That is, in the printing apparatus according to the embodiment, the worker causes the temperature of the drying unit 4 to be decreased, and can change the temperature (standby temperature) at which the drying unit 4 is maintained after the decrease of the temperature.

Moreover, with respect to the medium 7 in which a heat resistance property of the medium 7 is weak and the thermal damage is generated in a case in which the standby temperature is 50° C., it is preferable that the standby temperature be further decreased than 50° C., and the first mode is applied. That is, in the first mode, depending on the types of the medium 7 (heat resistance property of medium 7), the temperature (standby temperature) at which the drying unit 4 is maintained after the decrease of the temperature is preferably changed.

The invention is not limited to the embodiments described above, and can be appropriately modified within a range not contrary to a gist or an idea being read from claims and the entire specification, and various modification examples other than the above-described embodiments are conceivable.

Modification Example 1

In the transporting process of the medium 7 (S103) in Embodiments 1 and 2, the intermittent transportation is performed in the transporting direction which is a direction where the medium 7 is transported toward the bring-out port 28 from the bring-in port 27, but the medium may be transported at a constant speed in the transporting direction which is the direction where the medium 7 is transported toward the bring-out port 28 from the bring-in port 27. Even in a case in which the medium 7 is transported at a constant speed, it is possible to exhibit the same effect as a case in which the medium 7 is intermittently transported, for example, the thermal damage such as wrinkles is not easily generated in the medium 7 by the heating process in the drying unit 4.

Therefore, the transporting process of the medium 7 (S103) in a period from performing S101 to determination of Y in S105 (the interruption work period from starting the interruption work to finishing the interruption work) or in a partial period thereof, it is preferable that the medium be transported at a constant speed or intermittently transported.

Modification Example 2

In a case in which the maintenance work in Embodiment 2 is performed, a temperature of the platen 30 may be decreased or increased so as to be the same as the temperature of the drying unit 4.

In detail, the printing apparatus according to the modification example may include a configuration in which, in a case in which the printing is temporarily stopped and the predetermined maintenance work is performed, the temperature of the platen 30 is decreased by performing a control of electric connection to the heater 38 or a temperature control of the heater 38 after the maintenance work starts, and the temperature of the platen 30 is increased by performing the control of electric connection to the heater 38 or the temperature control of the heater 38 after the maintenance work.

Further, the printing apparatus according to the modification example may include a configuration in which, in a case in which the printing is temporarily stopped and the predetermined maintenance work is performed, the temperature of the platen 30 is decreased by performing the control of electric connection to the heater 38 or the temperature control of the heater 38 after the maintenance work starts, and the temperature of the platen 30 is increased by performing the control of electric connection to the heater 38 or the temperature control of the heater 38 during the maintenance work.

With such a configuration, in a case in which the printing is temporarily stopped and the maintenance work is performed, an adverse influence on the medium 7 can be further reduced.

Modification Example 3

In Embodiments 1 and 2, the printing apparatus including the recording head 34 as a liquid ejecting head is described as an example of an electronic device, but the invention can be applied to other electronic devices. For example, the invention can also be applied to a color material ejecting apparatus including a color material ejecting head being used for manufacturing a color filter such as a liquid crystal display, an electrode material ejecting apparatus including an electrode material ejecting head being used for forming an electrode such as an organic electro luminescence (EL) display or a surface emitting display (FED), and a bioorganic ejecting apparatus including a bioorganic ejecting head being used for manufacturing a biochip (biochemical element).

This application claims priority under 35 U.S.C. § 119 to Japanese Patent Application No. 2017-026669, filed Feb. 16, 2017. The entire disclosure of Japanese Patent Application No. 2017-026669 is hereby incorporated herein by reference.

What is claimed is:

1. A printing apparatus comprising:

a printing unit configured to perform printing on a medium during a stoppage of the medium, wherein:

during the stoppage of the medium, the printing unit repeats a main scanning and a sub scanning while printing a frame of image on the medium, during each main scanning, the printing unit ejects ink to the medium while moving in a first direction, and during each sub scanning, the printing unit moves in a second direction intersecting the first direction, a drying unit that includes a bring-in port where the medium is brought in and a bring-out port where the medium is brought out, and dries ink applied onto the medium; and a transporting unit configured to intermittently transport the medium in a transporting direction, wherein:

the transport unit repeats a transporting process and a stop process, during the transporting process, the transporting unit transports the medium in the transporting direction by an intermittent transporting distance, and during the stop process, the transporting unit stops the medium being transported in the transporting direction, wherein, in a case in which printing is temporarily stopped and a predetermined interruption work is performed, the medium is transported in the transporting direction which is a direction toward the bring-out port from the bring-in port in an interruption work period from starting the interruption work to finishing the interruption work or in a partial period of the interruption work period.

2. The printing apparatus according to claim 1, wherein the medium is transported at a constant speed or is intermittently transported in the interruption work period or in the partial period of the interruption work period.

3. The printing apparatus according to claim 1, wherein a transporting distance of the medium being transported in the transporting direction in the interruption work period or in the partial period of the interruption work period is the intermittent transporting distance.

4. The printing apparatus according to claim 1 wherein, in a case in which an interruption work period moving distance, which is a transporting distance of the medium being transported in the transporting direction in the interruption work period or in the partial period of the interruption work period, becomes shorter than the intermittent transporting distance, the medium is further transported in the transporting direction by a difference distance obtained by subtracting the interruption work period moving distance from the intermittent transporting distance after the interruption work period.

5. The printing apparatus according to claim 1, wherein, in a case in which an interruption work period moving distance, which is a transporting distance of the medium being transported in the transporting direction in the interruption work period or in the partial period of the interruption work period, becomes longer than the intermittent transporting distance, the medium is further transported in an opposite direction to the transporting direction by a difference distance obtained by subtracting the intermittent transporting distance from the interruption work period moving distance after the interruption work period.

6. The printing apparatus according to claim 1, wherein the printing apparatus includes a first mode in which a temperature of the drying unit is decreased by performing a control of electric connection to a heater of the drying unit or a temperature control of the heater after starting the interruption work, and the temperature of the drying unit is increased by performing the control of electric connection to the heater of the drying unit or the temperature control of the heater after the interruption work, and a second mode in which the temperature of the drying unit is decreased by performing the control of electric connection to the heater or the temperature control of the heater after starting the interruption work, and the temperature of the drying unit is increased by performing the control of electric connection to the heater or the temperature control of the heater during the interruption work.

7. The printing apparatus according to claim 6, wherein, in the first mode, the control of electric connection to the heater or the temperature control of the heater is performed so that the temperature of the drying unit becomes a standby temperature which is lower than a temperature at the time of starting the interruption work after the starting the interruption work, and wherein the standby temperature is varied depending on the types of the medium.

* * * * *